US010182675B2

(12) United States Patent
Shendelman

(10) Patent No.: US 10,182,675 B2
(45) Date of Patent: Jan. 22, 2019

(54) PORTABLE FOOD HANDLING DEVICES

(71) Applicant: Leonid Shendelman, Brooklyn, NY (US)

(72) Inventor: Leonid Shendelman, Brooklyn, NY (US)

( * ) Notice: Subject to any disclaimer, the term of this patent is extended or adjusted under 35 U.S.C. 154(b) by 0 days.

(21) Appl. No.: 15/879,533

(22) Filed: Jan. 25, 2018

(65) Prior Publication Data

US 2018/0213958 A1 Aug. 2, 2018

Related U.S. Application Data

(63) Continuation-in-part of application No. 15/150,743, filed on May 10, 2016, now Pat. No. 9,901,202, which is a continuation-in-part of application No. 14/215,662, filed on Mar. 17, 2014, now Pat. No. 9,345,352.

(60) Provisional application No. 61/790,285, filed on Mar. 15, 2013.

(51) Int. Cl.

| | |
|---|---|
| ***A47G 21/00*** | (2006.01) |
| ***A47F 1/12*** | (2006.01) |
| ***A47G 23/06*** | (2006.01) |
| ***A47G 19/06*** | (2006.01) |

(52) U.S. Cl.

CPC ..... *A47G 21/001* (2013.01); *A47F 1/125* (2013.01); *A47G 19/06* (2013.01); *A47G 23/0625* (2013.01); *A47G 2023/0666* (2013.01); *A47G 2200/106* (2013.01)

(58) Field of Classification Search

CPC ... A47B 13/16; A47G 21/001; A47G 23/0625

USPC ..... 108/26, 25, 27, 50.01, 50.02, 50.11, 108/50.18; 211/162, 85.4, 51; 206/216, 206/575; 221/223, 123, 132, 124; 220/23.87, 49.03

See application file for complete search history.

(56) References Cited

U.S. PATENT DOCUMENTS 1,221,217 A * 4/1917 Quinliven et al. ..... A47F 1/10 221/119
1,734,045 A * 11/1929 Parran ..... G07F 11/00 194/300
2,013,901 A * 9/1935 Shankland ..... A47F 1/10 221/132
2,049,114 A * 7/1936 Gallamore ..... A47B 3/083 108/25
3,193,139 A * 7/1965 Iannone ..... G07F 11/045 194/300

(Continued)

*Primary Examiner* — Jose V Chen
(74) *Attorney, Agent, or Firm* — Kirschstein, Israel, Schiffmiller & Pieroni, P.C.

(57) ABSTRACT

A food handling device includes a holder having an interior chamber extending along a longitudinal axis, and an extension housing detachably mounted on the holder and having an interior compartment for receiving and for holding the foodstuff. A pusher is mounted in the chamber for axial movement. An actuator axially moves the pusher through the chamber and through the compartment into contact with the foodstuff, and incrementally feeds a continuously variable quantity of the foodstuff along the longitudinal axis through the opening directly into a user's mouth to enable the foodstuff to be eaten bite-by-bite in a sanitary manner without using eating accessories, such as plates and/or utensils, and without the user's hands directly touching and contaminating the foodstuff, thereby preventing the spread of disease.

23 Claims, 26 Drawing Sheets

(56) References Cited

U.S. PATENT DOCUMENTS

| | | | | | |
|---|---|---|---|---|---|
| 3,344,951 | A * | 10/1967 | Gervais | B65D 83/0418 | 221/198 |
| 4,295,579 | A * | 10/1981 | Haas | B65D 83/0418 | 206/536 |
| 4,589,575 | A * | 5/1986 | Rigberg | B65D 83/0418 | 206/535 |
| 5,012,936 | A * | 5/1991 | Crum | A47F 1/126 | 206/556 |
| 5,071,033 | A * | 12/1991 | Siwek | B65D 83/0409 | 221/229 |
| 5,178,298 | A * | 1/1993 | Allina | B65D 83/0418 | 206/457 |
| 5,413,229 | A * | 5/1995 | Zuberbuhler | A47F 1/12 | 211/51 |
| 5,460,295 | A * | 10/1995 | Law | A44C 5/003 | 221/185 |
| 5,493,976 | A * | 2/1996 | Hammond | A47B 37/04 | 108/50.12 |
| 6,543,639 | B1 * | 4/2003 | Kovens | B65D 83/0418 | 221/217 |
| 7,703,636 | B2 * | 4/2010 | Sus | B65B 43/305 | 221/150 A |
| 9,345,352 | B2 * | 5/2016 | Shendelman | A47G 23/0625 | |
| 9,901,202 | B2 * | 2/2018 | Shendelman | A47G 21/001 | |
| 2013/0277243 | A1 * | 10/2013 | Wu | A47G 7/06 | 206/216 |

* cited by examiner

FIG. 10
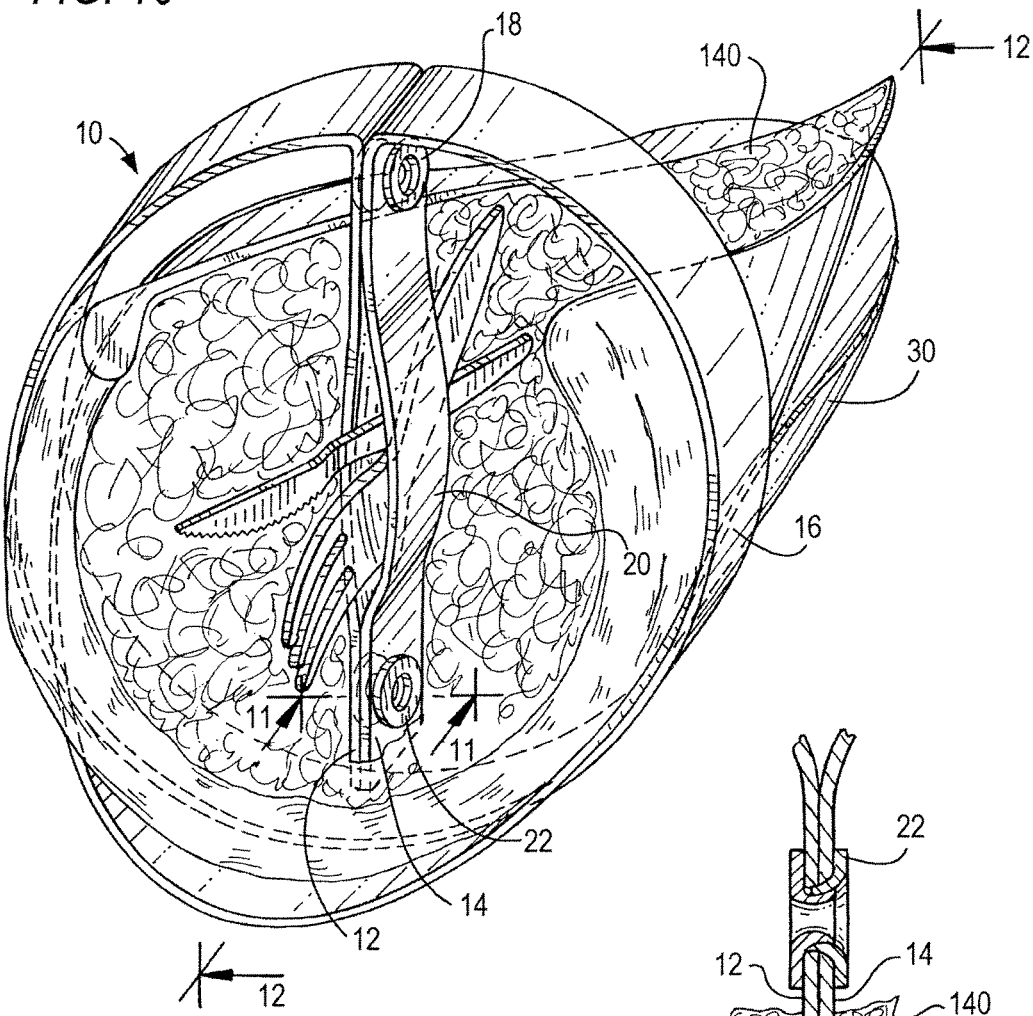
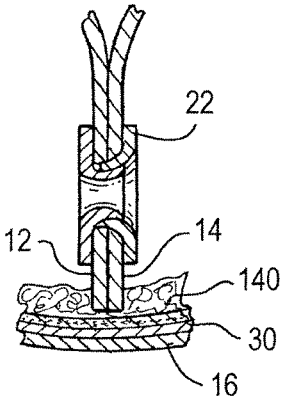
FIG. 11

FIG. 21
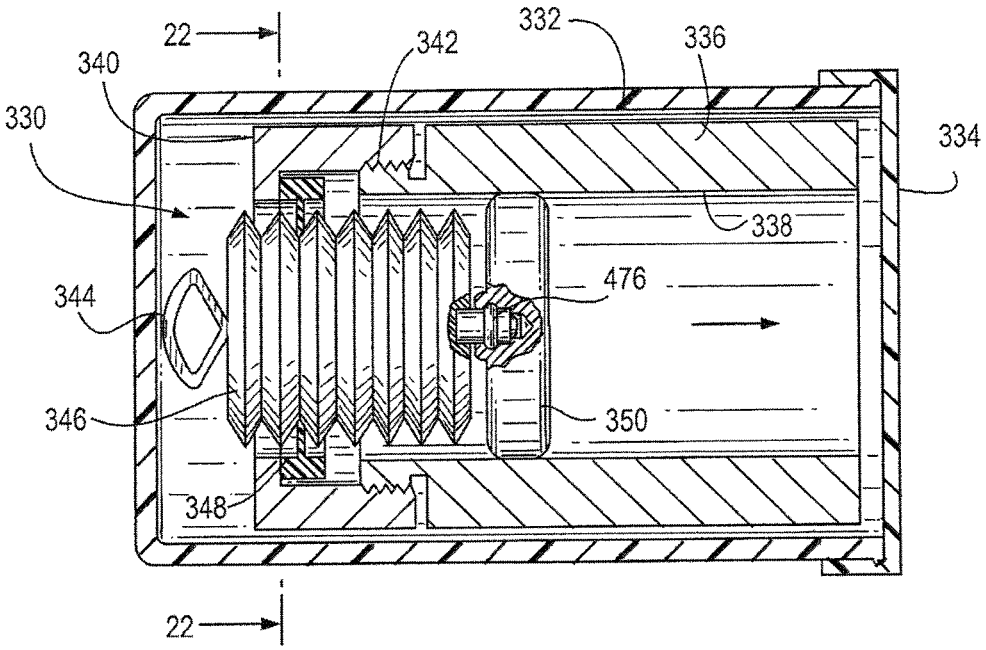
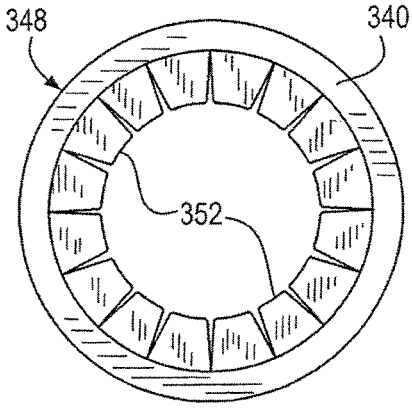
FIG. 22
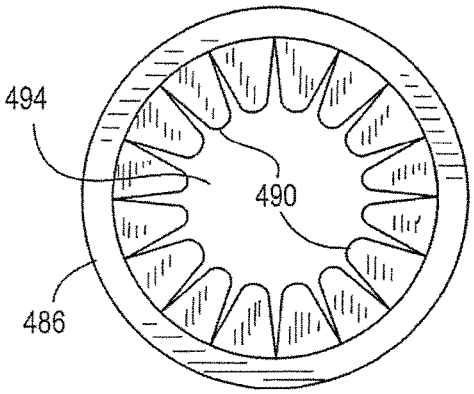
FIG. 25

382
384
380
376
374

374
376
362
364
382
380

372
368
364
362
370
366
360

FIG. 29
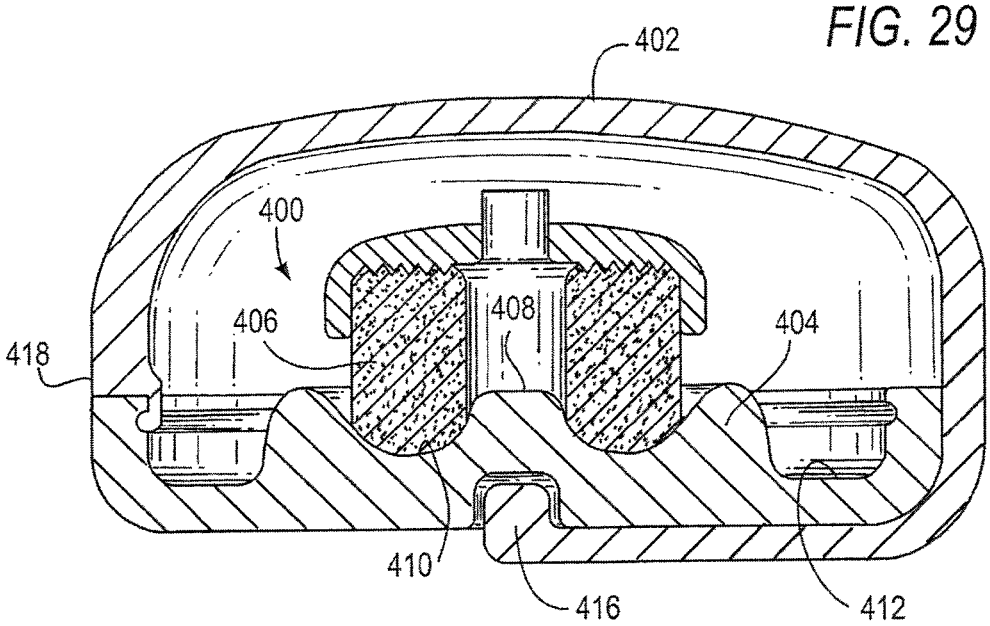
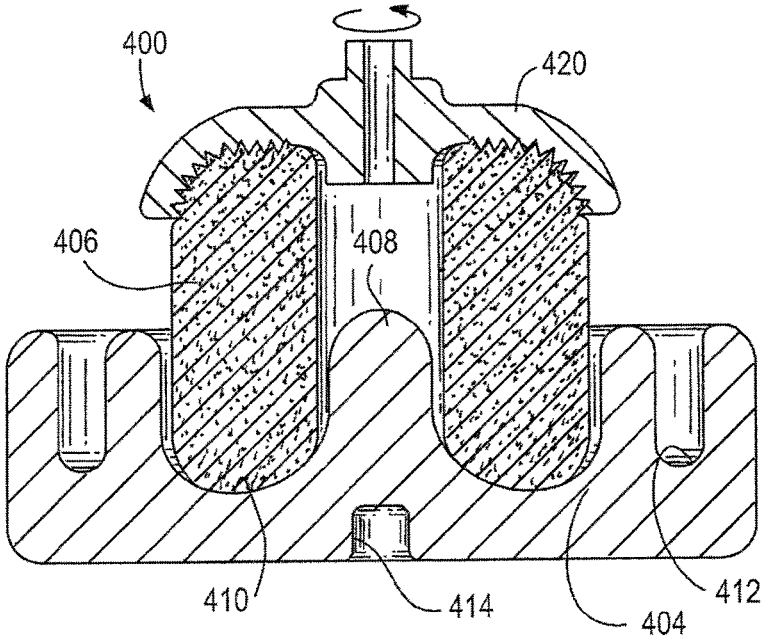
FIG. 30

FIG. 32
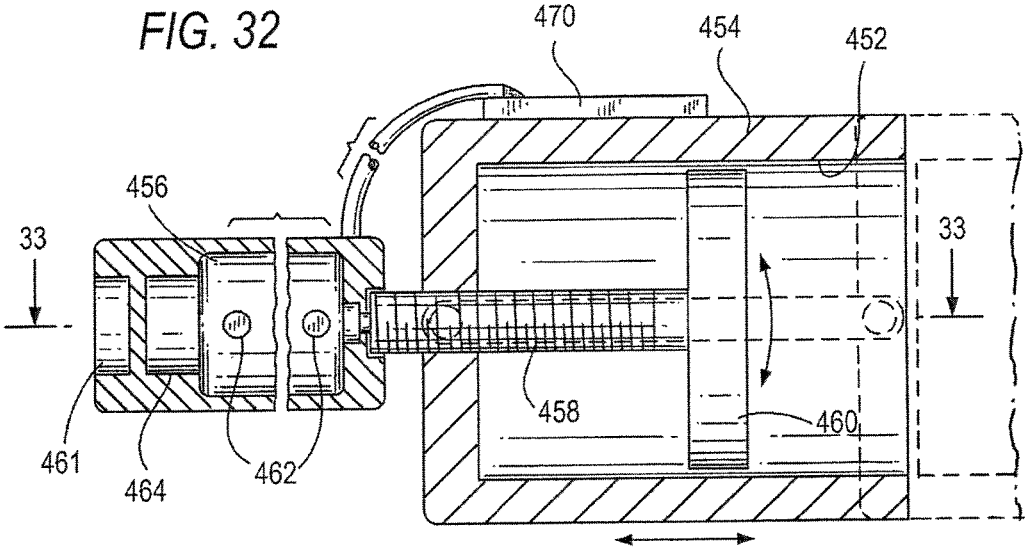
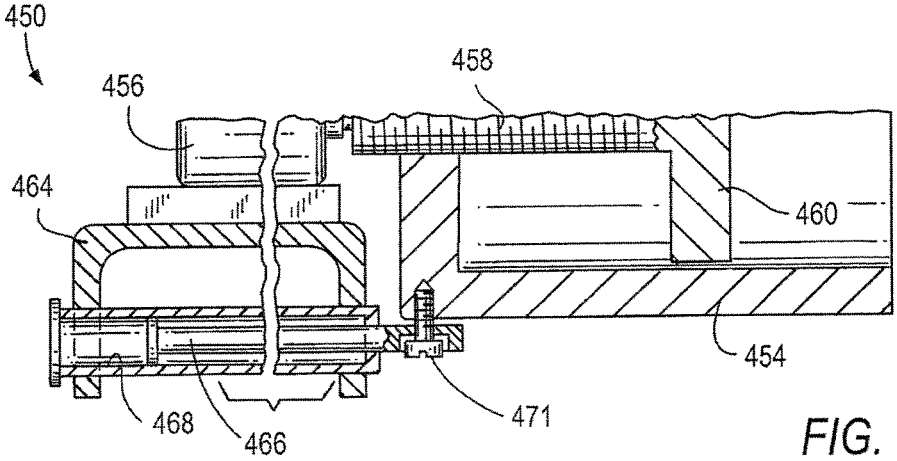
FIG. 33

PORTABLE FOOD HANDLING DEVICES

CROSS REFERENCE TO RELATED APPLICATION

This application is a continuation-in-part of U.S. patent application Ser. No. 15/150,743, filed May 10, 2016, now allowed, which, in turn, is a continuation-in-part of U.S. patent application Ser. No. 14/215,662, filed Mar. 17, 2014, now U.S. Pat. No. 9,345,352, which claims priority to U.S. Provisional Patent Application No. 61/790,285, filed Mar. 15, 2013, the entire contents of which is hereby expressly incorporated herein by reference thereto.

BACKGROUND

The present disclosure generally relates to portable food handling devices for use during eating foodstuffs, especially those often considered as difficult, awkward, or messy to handle, such as slices of pizza, hot dogs, sushi, doughnuts, bagels, salads, cakes, etc., and, more particularly, for holding and eating such foodstuffs in a sanitary, tidy manner, that is without soiling one's hands, without spilling drippings, pieces, or toppings of the foodstuff, without having one's hands directly touch and contaminate the foodstuff to thereby prevent the spread of disease, and without using any traditional eating accessories, such as plates, and/or utensils, such as knives, spoons, chopsticks, and forks, and, still more particularly, relates to portable food handling devices that are used to feed solid and/or non-solid foodstuffs in a comfortable and sanitary maimer directly to a user's mouth without using such eating accessories and can be beneficial in both indoor and outdoor activities, sports arenas, cafeterias, hospitals, rehabilitation facilities, schools, universities, cars, boats, planes, as well as in disaster relief kits, and the like. In addition, the food handling devices are advantageously sized to fit inside lunch boxes. In its broadest aspect, the devices disclosed herein can even handle and dispense non-food items.

Pizza is an example of a foodstuff that is often difficult to handle, especially when the foodstuff is hot. The commonest form in which pizza is served is a generally triangular sector slice taken from a circular pie, generally formed when the pie is cut by several diametrical slices. This form is difficult to handle mostly because of the soft and limp nature of the pointed end, which tends to droop and allow any loose toppings, usually lubricated by cheese and sauce, to slide off and often end up on the user's hands, food tray, or lap, or on the floor. Other types of messy foods include, for example, a hot dog, especially when smothered with multiple loose toppings, a hamburger, a gyro, a taco, a burrito, sushi, a salad, a cake, etc. Frequently, toppings, including sauce, can fall off from the foodstuff, even when held with two hands. Even non-food items can sometimes be difficult to handle and dispense in a sanitary manner.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the instant disclosure, and explain various principles and advantages of those embodiments.

FIG. 10 is a front perspective view of another embodiment of a food handling device in accordance with this disclosure.

FIG. 11 is a sectional view taken on line 11-11 of FIG. 10.

FIG. 21 is a sectional view of an additional embodiment of a food handling device in accordance with this disclosure.

FIG. 22 is a side view taken on line 22-22 of FIG. 21.

FIG. 25 is an end view of the detail of FIG. 24.

FIG. 29 is a sectional view of yet another embodiment of a food handling device in accordance with this disclosure.

FIG. 30 is an enlarged, sectional view of part of the food handling device of FIG. 29.

FIG. 32 is a part-sectional, part-diagrammatic, view of an additional embodiment of a food handling device in accordance with this disclosure.

FIG. 33 is a sectional view taken on line 32-32 of FIG. 32,

Figure 1:
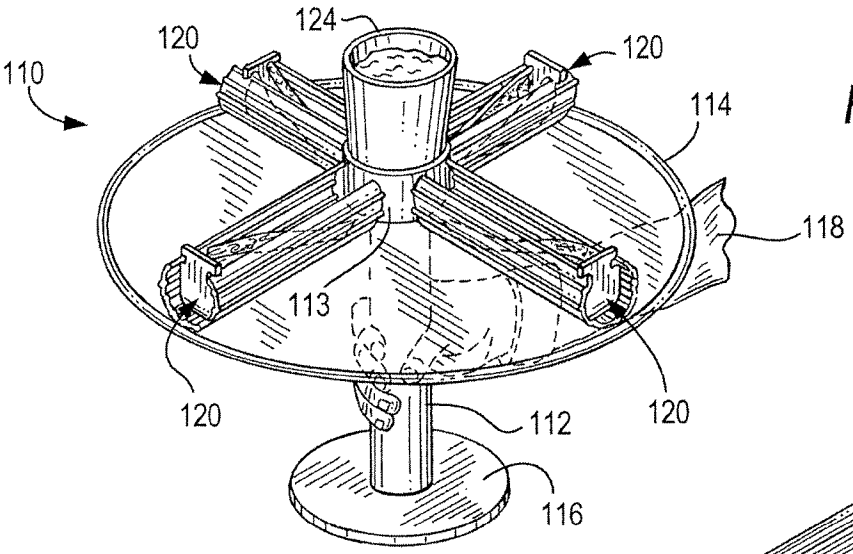
FIG. 1 is a perspective view of a portable food service assembly containing a plurality of food handling devices in accordance with this disclosure.
Figure 2:
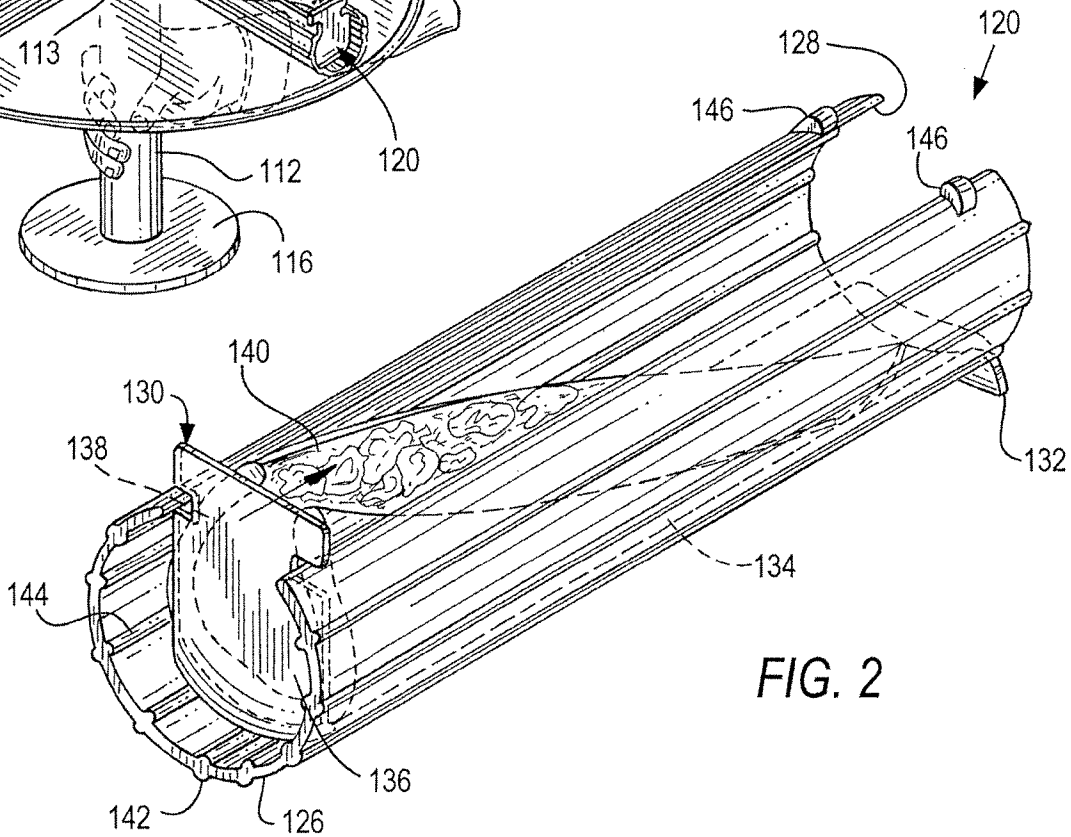
FIG. 2 is an enlarged perspective view of one of the food handling devices of the assembly of FIG. 1.
Figure 3:
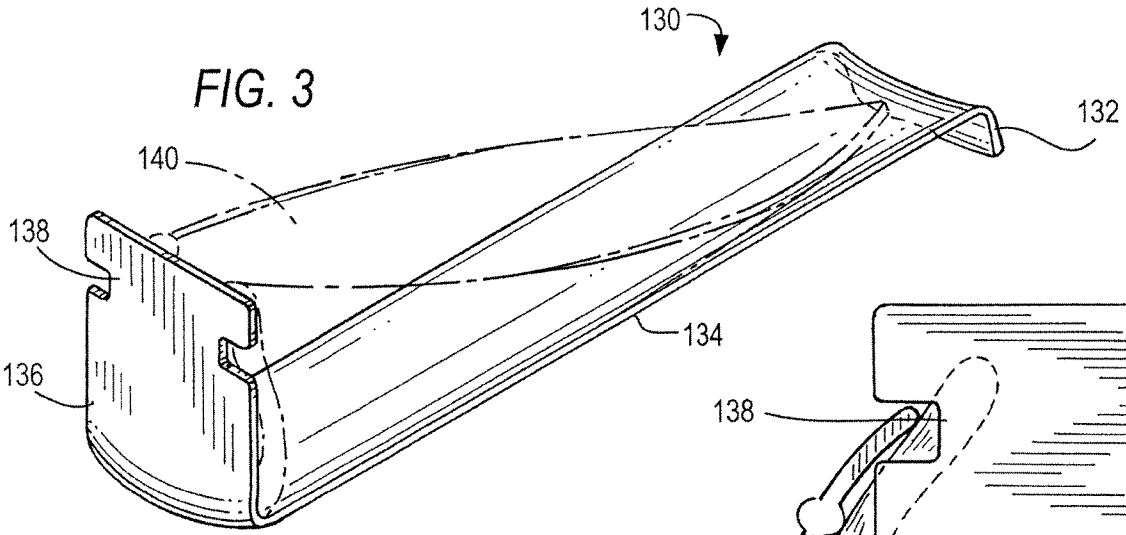
FIG. 3 is an enlarged perspective view of a detail of the device of FIG. 2.
Figure 4:
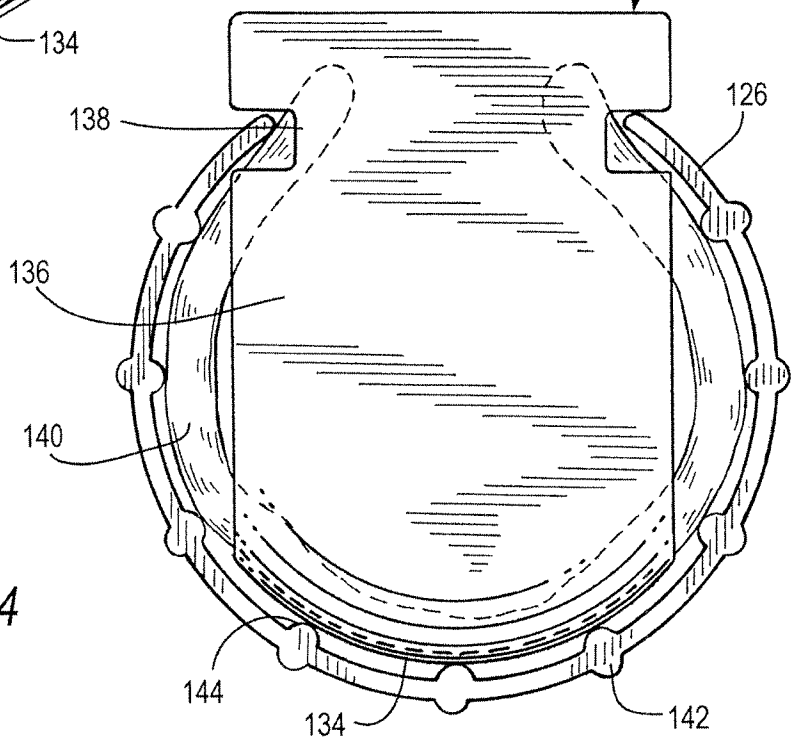
FIG. 4 is an enlarged end view of the device of FIG. 2.

Skilled artisans will appreciate that elements in the figures are illustrated for simplicity and clarity and have not necessarily been drawn to scale. For example, the dimensions and locations of some of the elements in the figures may be exaggerated relative to other elements to help to improve understanding of embodiments of the present disclosure, The devices and assembly components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DETAILED DESCRIPTION

Figure 16:
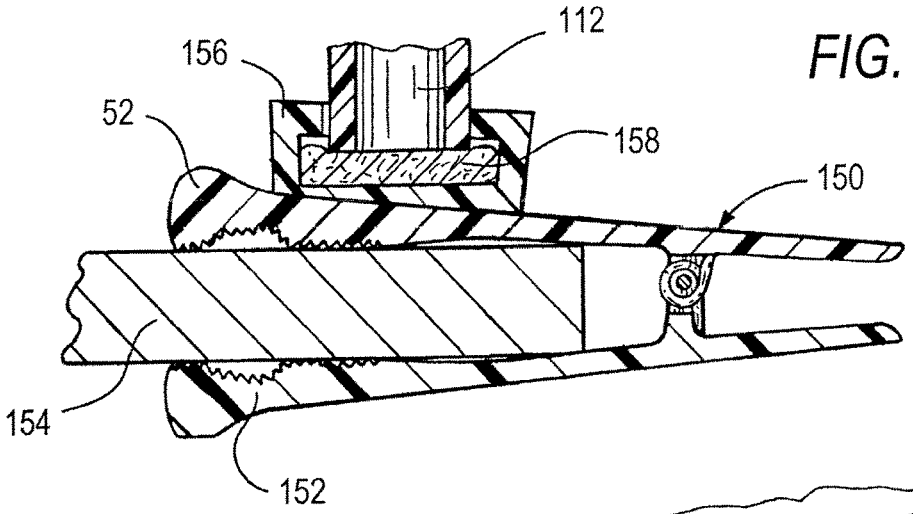
FIG. 16 is a broken-away, enlarged, sectional view of a variant mounting of the food service assembly of FIG. 1.
Figure 17:
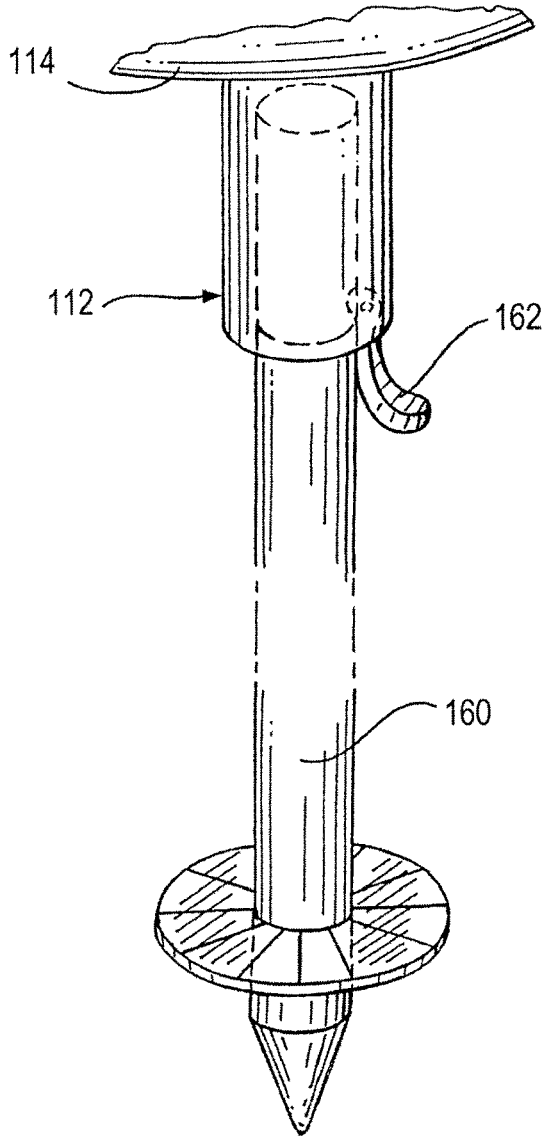
FIG. 17 is a broken-away, side view of another variant mounting of the food service assembly of FIG. 1.
Figure 18:
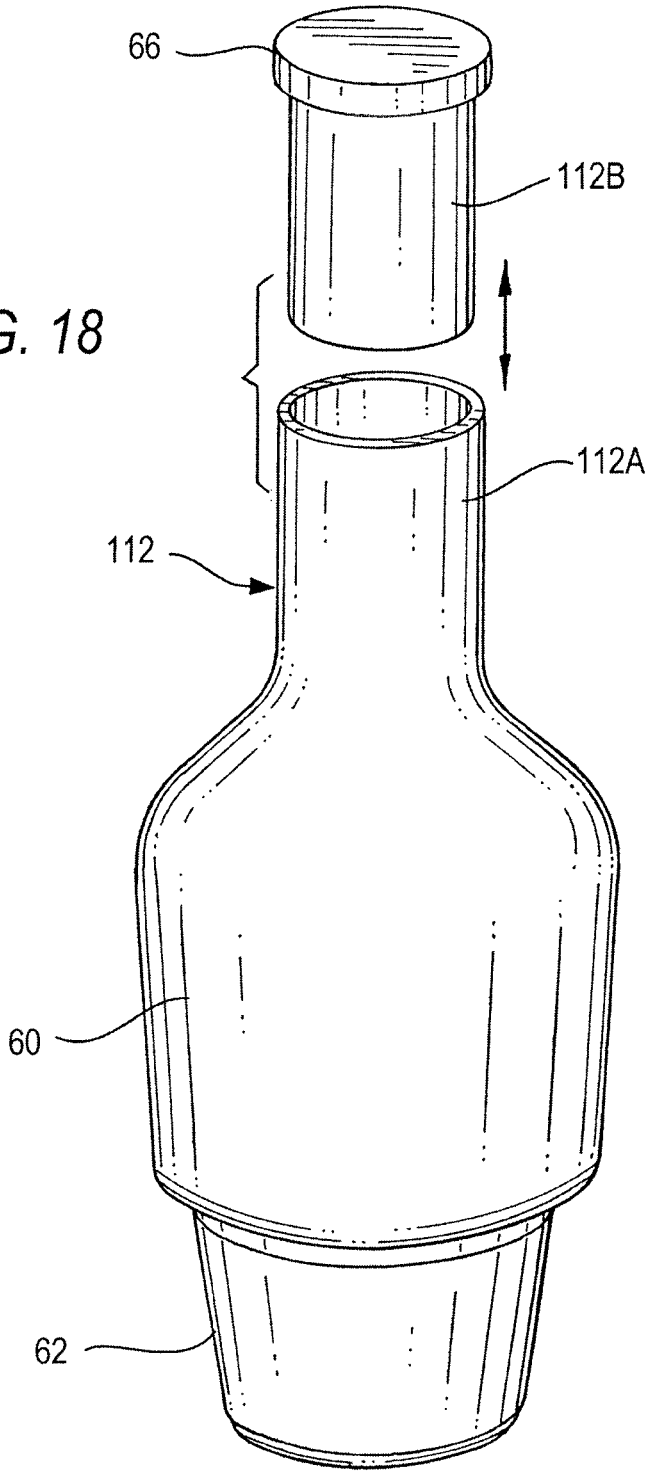
FIG. 18 is a broken-away, side view of another variant mounting of the food service assembly of FIG. 1.

Turning now to FIGS. 1-4, a portable service assembly 110 includes a plate or serving platter 114, a support 112 held by a user 118, and a base 116. The support 112 need not be a cylindrical column as illustrated in FIG. 1, hat could have other shapes, e.g., a stepped column, a frustoconical column, or a part-cylindrical and part-frustoconical column. The column could be solid or hollow, and has a diameter sized to be readily gripped in the palm of a user's hand so that the assembly 110 may easily be carried by one hand from place to place. The hollow interior of the column could be used to store any item, such as napkins, straws, electronic devices, eating accessories, writing implements, condiment packages, etc. The base 116 in FIG. 1 has a planar bottom surface for stable mounting on a support surface, such as the floor or a table. If the support surface is made of a magnetically attractable material, then, in one advantageous embodiment, the bottom surface of the base 116 may be constituted of a magnetic material for magnetic attraction to, and holding by, the magnetically attractable support surface. The base 116 could therefore be of one-piece with the column, or could be a separate detachable part that can be readily attached to the column. For example, the base 116 can be threadedly or magnetically attached to the column, or can be attached by a snap-type action. FIGS. 16-18, as described below, illustrate other mounting arrangements relative to support surfaces.

A drink container or liquid substance-containing cup 124 may be mounted, and held with a friction fit, in a central hollow cylindrical portion 113 of the assembly 110, preferably inside an opening in the platter 114. The container 124 may be removed and replaced at will. The container 124 need not be frustoconical in shape as illustrated, but could have other shapes, e.g., cylindrical. The container 124 may contain water, or cold beverages, such as soda, a milk shake, alcoholic beverages, etc., or hot beverages, such as coffee, tea, hot chocolate, soup, etc., or any semi-liquid substance, such as yogurt, hummus, mustard, ketchup, etc. Use of the container 124 is optional.

A plurality of food handling or dispensing devices 120 are radially arranged on the platter 114. The food holding devices 120 need not be radially arranged as shown, but could be arranged in different numbers and layouts. A representative food handling device 120 is shown individually in FIG. 2. The food handling device 120 includes a portable, elongated, tubular holder 126 bounding an interior in which a foodstuff, e.g., a slice of pizza, a pastry, a cake, a gyro, a doughnut, a taco, a hot dog, a hamburger, a burrito, a pirogue, a sandwich, a salad, sushi, etc., is placed. The holder 126 has a longitudinal channel or slot 128. The holder 126 can have various shapes, for example, a cylindrical shape, or a conical shape suitable for compact storage, transport, and handling. A movable member 130, shown individually in the embodiment of FIG. 3, has an elongated support portion or body 134, a handle portion 132 at one end of the body 134, an upright arm portion 136 at an opposite end of the body 134, and a neck portion 138. The movable member 130 is initially positioned inside the holder 126 such that the handle portion 132 is located outside an open axial end of the holder 126, and the neck portion 138 is positioned in the longitudinal slot 128.

Using a slice of pizza 140 (see FIG. 4) as an example of a foodstuff that can advantageously be placed inside the holder 126, the pizza slice 140 is placed on top of the movable member 130 such that its rear crust at its broader end is adjacent the upright arm portion 136. In use, the user 11$ takes one of the food handling devices 120 off the platter 14 with one hand, and brings the device 120 near the user's mouth. Then, the user 118 grips and manipulates the handle portion 132 with the user's other hand, and progressively pulls the movable member 130 towards the user 118 with the user's other hand, and incrementally slides the pizza slice 140 out of the holder 126, thereby enabling the user 118 to progressively advance the pointed front leading end of the pizza slice 140 in steps out of the holder 126 towards the user's mouth in order to eat the pizza slice 140 bite-by-bite in a sanitary manner, that is, without dropping any toppings from the pizza slice 140, without soiling one's hands, without having one's hands directly touch and contaminate the pizza slice 140 to thereby prevent spread of disease, and without requiring the use of, and eliminating the use of, any eating accessories, such as plates, and/or eating utensils. During the eating, the handle portion 132 is pulled down, thereby bending and folding the support portion 134 out of the way from the user's mouth. Advantageously, the movable member 130 is made of a bendable, flexible material. As noted above, pizza is an unusually difficult food to handle in a non-awkward manner. Prior to use of the food handling device 120, the pizza slice 140 and all its toppings are fully contained within the device 120. During eating, only the leading end of the pizza slice 140 is exposed for eating.

The holder 126 may have sensors 146 to indicate, and to record, the quantity of the foodstuff that has been moved a distance through the holder 126 and has been eaten. This recorded information can be stored, together with the caloric value of the particular foodstuff, and can be sent to remote monitoring facilities that calculate the user's daily calorie consumption data, to thereby monitor the health, and assist in controlling the weight of, the user. The holder 126, together with a foodstuff therein, may he placed in a refrigerator, and subsequently in a thermos or lunch box, for further subsequent consumption in any venue, for example, schools, food stands, workplaces, stadiums, recreational outdoor activities, sporting events, etc. As shown, the outer and inner walls of the holder 126 may be formed with raised outer ribs 142 and/or raised inner ribs 144. The outer ribs 142 enable the user 118 to more securely hold the holder 126. The channels between the inner ribs 144 may collect drippings from the pizza slice 140 or other foodstuff. Both the outer ribs 142 and the inner ribs 144 also serve as thermal insulators to prevent any heat from the pizza slice 140 or other hot foodstuff from being transferred to the user's hand. The holder 126 may be constituted of any material, for example, a resilient material that permits the holder 136 to be squeezed, but when constituted of a corrugated board material, the ribs 142, 144 are advantageously formed of the flutes or corrugations of the board material. The holder 126 may alternatively be provided with smooth outer and inner walls. The holder 126, together with the foodstuff, may also be microwaveable.

Figure 5:
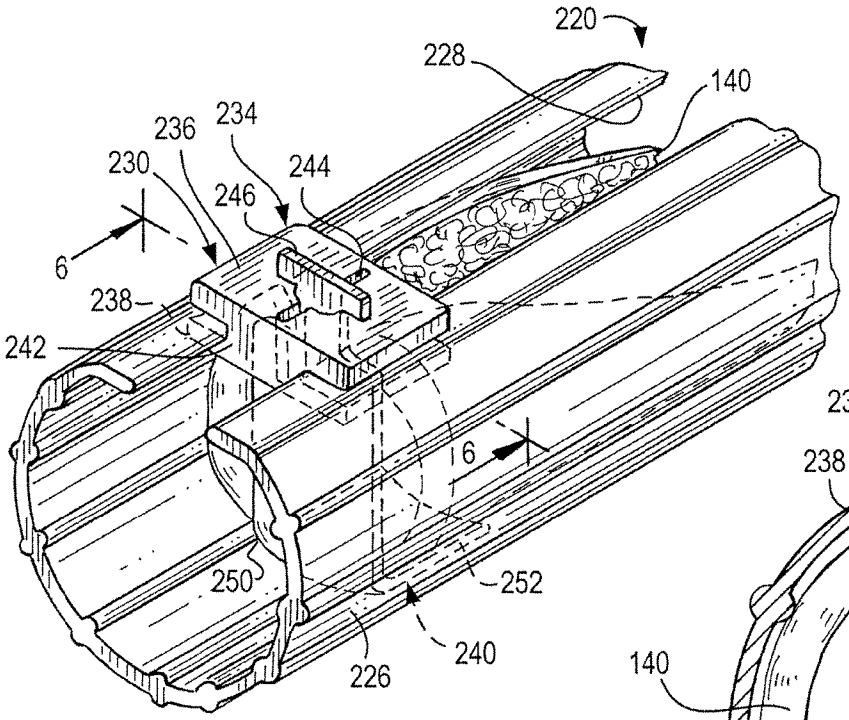
FIG. 5 is a broken-away, enlarged perspective view of another food handling device for the assembly of FIG. 1 in accordance with this disclosure.
Figure 6:
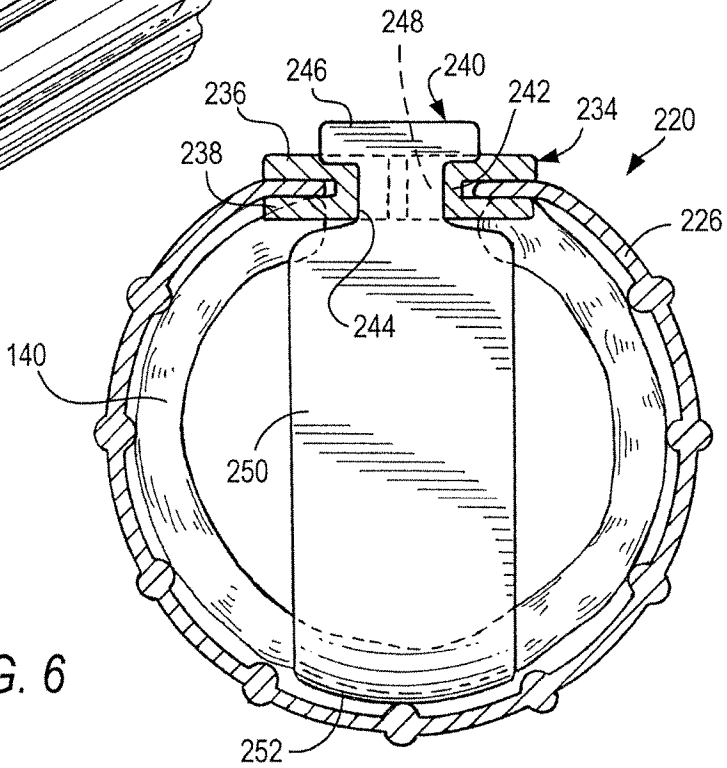
FIG. 6 is a sectional view taken on line 6-6 of FIG. 5.
Figure 7:
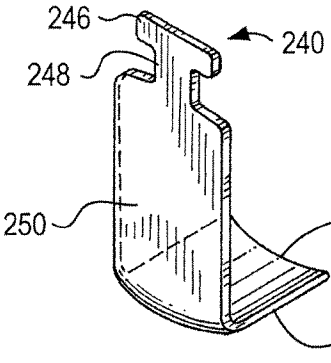
FIG. 7 is an enlarged, perspective view of a detail of the device of FIG. 5.

FIG. 5 depicts another embodiment of a food handling device 220 that is similar to the food handling device 120. The food handling device 220 includes a tubular holder 226 bounding an interior in Which the foodstuff 140, as described above, is placed. The holder 226 has a longitudinal channel or slot 228. The holder 226 can have various shapes, for example, a cylindrical shape, or a conical shape suitable for compact storage, transport, and handling. A pulling assembly 230 includes a bracket 234 mounted on the holder 226 for sliding longitudinal movement lengthwise of the slot 228, and a movable member 240 shown individually in FIG. 7. As best seen in FIG. 6, the bracket 234 has an outer flange 236 located outside the holder 226, an inner flange 238 located inside the holder 226, a connecting portion 242 that interconnects the flanges 236, 238 and that is located in the slot 228, arid a passage 244 that extends through the flanges 236, 238 and the connecting portion 242. The movable member 240 has a handle portion 246 at one end, a neck portion 248 that extends through the passage 244, an upright arm portion 250, and an elongated body or support portion 252 that preferably terminates in a concave edge 254. The handle portion 246 is positioned perpendicularly to the passage 244. Prior to use of the food handling device 220, the pizza slice 140 and all its toppings are fully contained within the device 220. During eating, only the leading end of the pizza slice 140 is exposed for eating.

Again using the pizza slice 140 as an example of a foodstuff that can advantageously be placed inside the holder 226, the pizza slice 140 is placed on top of the movable member 240 such that its rear crust at its broader end is adjacent the upright arm portion 250. In a variation, the pizza slice 140 need not be placed on top of the movable member 240, but instead, could be positioned axially adjacent the pizza slice 140. In use, the user 118 holds the device 220 with one hand near the user's mouth. Then, the user grips the handle portion 246 or the bracket portion 234 with the user's other hand, and progressively pulls the movable member 240 towards the user with the user's other hand, and incrementally slides the bracket 234 and the movable member 240 lengthwise of the slot 228 and the holder 226, thereby enabling the user to progressively advance the pointed front leading end of the pizza slice 140 in steps out of the holder 226 in order to eat the pizza slice 140 bite-by-bite in a sanitary manner, that is without spilling any toppings, without soiling one's hands, without one's hands directly touching and contaminating the pizza slice to prevent the spread of disease, and without requiring, and eliminating, the use of any traditional eating accessories, such as plates and/or utensils. The movable member 240 can either carry the pizza slice, or push the pizza slice 140, during such movement.

Figure 8:
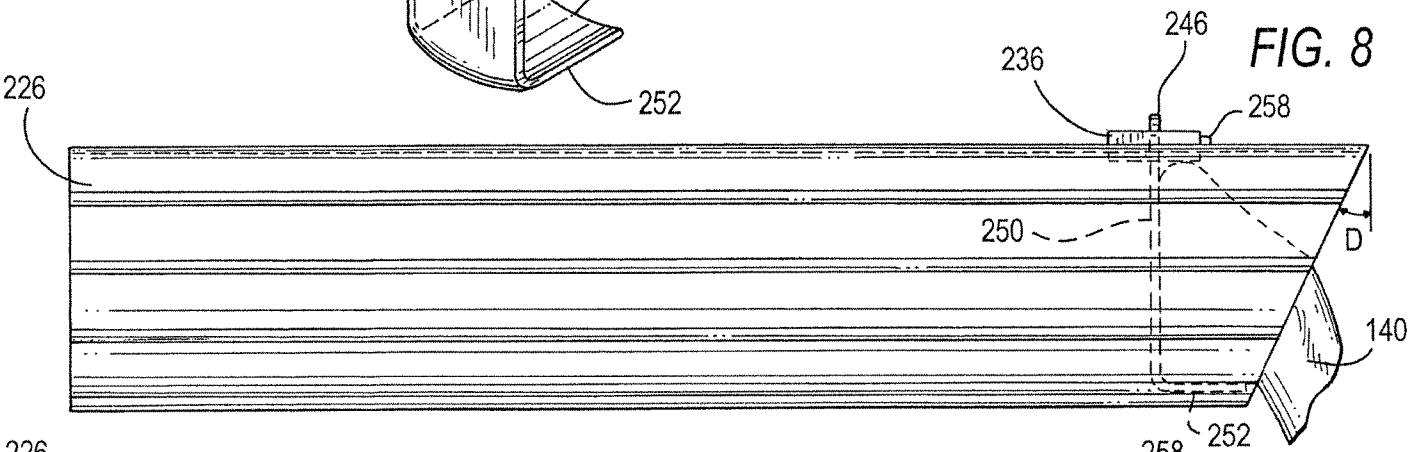
FIG. 8 is an enlarged, side view of the device of FIG. 5.

The concave edge 254 helps to insure that the user will not bite down hard on the movable member 240 during eating. Similarly, as shown in FIG. 8, the outer end of the holder 226, i.e., the end that is closest to the user's mouth during eating, is rearwardly tapered by an angle "D", to again prevent the user from biting down hard on the outer end of the holder 226. The concave edge 254 on the movable member 240 and the outer tapered end of the holder 226 could also be implemented on the movable member 130 and the holder 126 described above. A plurality of food handling devices 220 may be arranged on the platter 114 in analogous manner to that described above for food handling devices 120.

Figure 9:
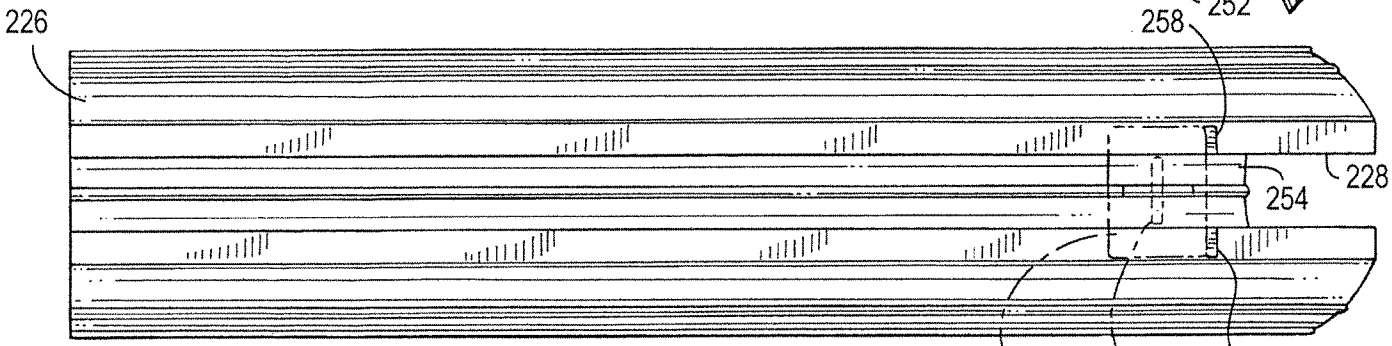
FIG. 9 is an enlarged top plan view of FIG. 8.

FIG. 9 also depicts a pair of stops 258 that abut against the upper flange 236 of the sliding bracket 234 and prevent the sliding bracket 234 from moving past the stops 258. Similar stops could be provided on the holder 126 described above to prevent the movable member 130 from moving off the holder 126. In addition, the holder 226 could be provided with the above-described sensors 146. The holder 226 is advantageously constituted of the same materials described above for holder 126, Turning now to the food handling device 10 of FIGS. 10-12, a portable holder is configured from an elongated, adjustable strip having opposite end regions 12, 14 that are brought together to form an annular body portion 16 bounding an interior. The strip is advantageously made of a resilient material, such as plastic, but could also be made of other materials. A first pair of fasteners 18 is fastened together, and a second pair of fasteners 22 is fastened together, each fastener being preferably of the snap type, with enough excess material from the strip, to form an annular central portion 20. The above-described foodstuff 140 is supported on a movable member 30, and they are jointly mounted within the interior of the annular body portion 16. The opposite end regions 12, 14 extend at least partly diametrically across the annular body portion 16 into engagement with the foodstuff 140 and serve as a resilient holding portion for fixedly holding the foodstuff 140 against movement. A plurality of eating accessories, such as plates and/or utensils, e.g., a knife, fork, spoon, or pair of chopsticks, as well as napkins or straws, are mounted and held within the annular central portion 20. Other foodstuffs, such as carrots, celery and the like can be mounted and held within the annular central portion 20. In addition, one or more such eating accessories could be mounted in a V-shaped recess located at the top of the annular body portion 16.

Figure 12:
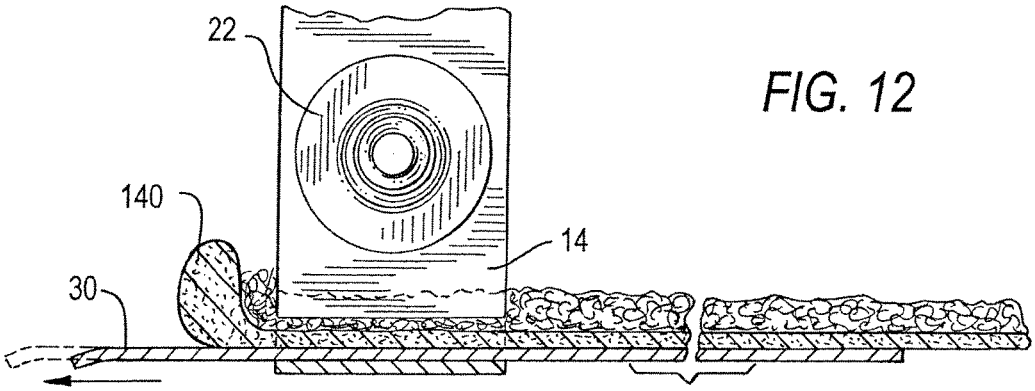
FIG. 12 is a sectional view taken on line 12-12 of FIG. 10.

In use, as shown in FIG. 12, the pizza slice 140 is placed on the movable member 30, advantageously configured as a plate, e.g., a paper plate, and the plate with the pizza slice 140 thereon are bent into a curved shape to conform to the inner circumferential surface of the annular body portion 16 and jointly placed underneath the resilient holding portion 12, 14, which advantageously is first pushed up to make clearance for the curved plate with the pizza slice 140 thereon, and then released to return by spring action from the central portion 20 to the illustrated position. As noted above, the resilient holding portion 12, 14 engages the pizza slice 140 and holds the same stationary. Then, the user 118 holds the device 10 with one hand, and grips a rear portion of the movable member 30 with the other hand, and progressively pulls the movable member 30 along a longitudinal direction relative to the pizza slice 140 away from the user with the other hand, thereby enabling the user to incrementally expose the pointed front end of the pizza slice 140 in order to eat the pizza slice 140 bite-by-bite in a sanitary manner, that is without spilling any toppings, without soiling one's hands, without one's hands directly touching and contaminating the pizza slice 140 to prevent the spread of disease, and without requiring, and eliminating, the use of any eating accessories, such as plates and/or utensils. A plurality of food handling devices 10 may be arranged on the platter 114 in analogous manner to that described above for food handling devices 120, 220.

Figure 13:
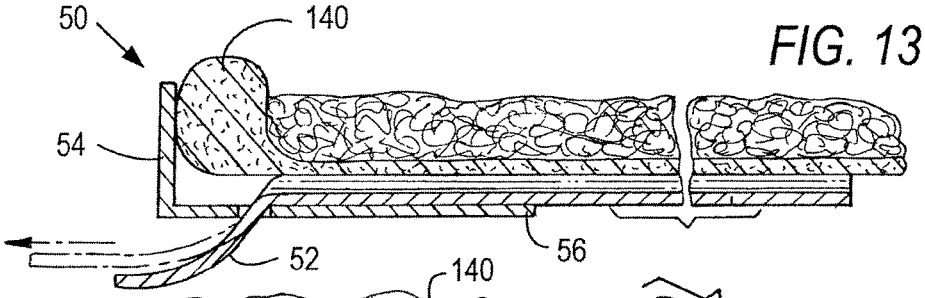
FIG. 13 is a broken-away, side view of another embodiment of a food handling device in accordance with this disclosure.
Figure 14:
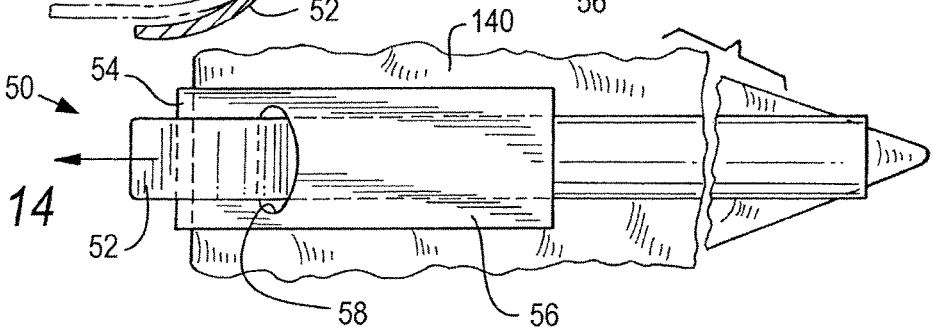
FIG. 14 is a broken-away, bottom plan view of the device of FIG. 13.

Turning now to the food handling or dispensing device 50 of FIGS. 13-14, a portable holder includes a base portion 56 on which a movable member 52 and the above-described foodstuff 140 are supported, a raised projection 54 for holding the foodstuff 140, and a slot 58 through which the movable member 52 passes. Preferably, the movable member 42 is curved in an arch to add strength to support the pizza slice 140. In use, as shown in FIG. 13, the user 118 holds the holder with one hand, grips a rear portion of the movable member 52 with the other hand, and progressively pulls the movable member 52 through the slot 58 along a longitudinal direction relative to the pizza slice 140 away from the user with the other hand, thereby enabling the user to incrementally expose the pointed front end of the pizza slice 140 in steps in order to eat the pizza slice 140 bite-by-bite in a sanitary manner, that is without spilling any toppings, without soiling one's hands, without one's hands directly touching and contaminating the pizza slice 140 to prevent the spread of disease, and without requiring, and eliminating, the use of any traditional eating accessories, such as plates and/or utensils. The raised projection 54 serves as a stop flange against which the rear end of the pizza slice 140 abuts, and holds the pizza slice 140 in a fixed position during movement of the movable member 52. In a variation, the raised projection 54 can be a pointed barb or tooth which pierces the pizza slice 140 to fix the latter in a stationary position. A plurality of food handling devices 50 may be arranged on the platter 114 in analogous manner to that described above for food handling devices 120, 220, 10.

Figure 15:
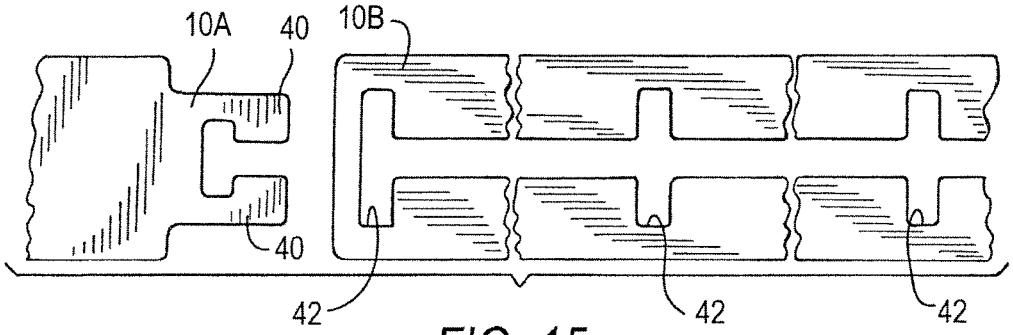
FIG. 15 is a broken-away, side view of a detail of the food handling device of FIG. 10.

FIG. 15 depicts one method of adjusting the perimeter of the annular body portion 16 of the device 10. Thus, one end portion 10A of the strip has a projecting portion with a pair of resilient prongs 40, and the other end portion 10B of the strip has a plurality of recesses 42 arranged successively apart lengthwise of the strip. The resilient prongs 40 engage with a snap type action into any selected one of the recesses 42 to adjust the perimeter of the annular body portion 16 of the strip to accommodate different sizes and shapes of the foodstuff and the movable member placed therein.

Thus, for the food handling devices 10, 50, the pizza slice 140 is held stationary, while each moving member 30, 52 is moved relative to the pizza slice 140 away from the user. By contrast, for the food handling devices 120, 220, the movable members 130, 240 are jointly movable with their respective pizza slices 140 towards the user, As described so far, the lower end of the support 112 of the food service assembly is adapted to be supported on top of a generally horizontal support surface, such as a table top or countertop, with the aid of the base 116. Other mounting configurations are also contemplated. For example, FIG. 16 depicts a spring-biased clip or clamp 150 having opposing jaws 152 that grip upper and lower surfaces of a generally horizontal support surface 154. The jaws 152 could also be concave to grip opposite sides of a different support surface, such as a round post or pole. The lower end of the support 112 is connected to the clamp 150 via an adapter 156 in which a resilient cushion 158 is received. The cushion 15$ compresses under the weight of the food service assembly and self-adjusts as needed in order to compensate for any tilting of the support 112 created by any variation in the size of the support surface 154 and any variation in the opening of the clamp 150. The adapter 156 need not be mechanically fixed to the clamp 150 as shown, but could be magnetically attached thereto, and could also be mounted for turning movement about a vertical axis thereon, As another example, the lower end of the support 112 can be mounted on a round post or pole staked into the ground or sand as on a beach, or in the snow. FIG. 17 depicts a ski pole 160 on which a food service assembly comprised of the platter 114 and the support 112 is detachably mounted with the aid of a tubular clamp 162.

As another example, as shown in FIG. 18, the lower end of the support 112 may be configured with a first enlarged frustoconically-shaped adapter portion 60 that, in turn, is located above a second enlarged frustoconically-shaped adapter portion 62. The adapter portions 60, 62 need not be frustoconically-shaped, and the support 112 may comprise only one of these adapter portions, or additional adapter portions. Each adapter portion 60, 62 is configured to be received in a correspondingly sized compartment in a cupholder that may be provided in a vehicle, such as a car, boat, or plane, typically in a console or dashboard area adjacent a seat, or in an armchair or seat, such as those located in theaters, arenas, stadiums, outdoor seating areas, etc. Thus, the support 112 of FIG. 18 enables the food service assembly 110 of FIG. 1 to be conveniently supported and stably held anyplace where a cupholder exists. No additional adapter is required, because at least one of the adapter portions 60, 62 will fit into the correspondingly sized compartment of the cupholder. This feature is of especial benefit when the user is being served at a drive-through station of a fast food store.

As also shown in FIG. 18, the support 112 may have an adjustable length. For example, the support 122 may comprise a pair of telescoping sections 112A, 112B whose overall length is adjustable by sliding one of the sections relative to the other of the sections. This adjustability may be used to position a food handling device at about the same elevation as a user's mouth. For example, a patient at a hospital or rehabilitation center, an invalid, or an incapacitated or handicapped person may he unable to use one of his or her hands to hold the food handling device, in which case, the food handling device may conveniently be placed on the platter 114 and remain thereon so that the platter 114 holds the food handling device. Then, the length of the support 112 and, hence, the elevation of the platter 114 relative to a support surface, e.g., the floor, a table, etc., can he varied to position the food handling device at about the same elevation as the user's mouth. The upper end 66 of the upper section 112B may be connected to the platter 114 by various types of connections, both detachable and permanent. For example, the platter 114 may be detachably mounted on the support 112 with a threaded fit, a non-threaded fit, a friction fit, an interference fit, a snap action fit, or a clearance fit.

Figure 19:
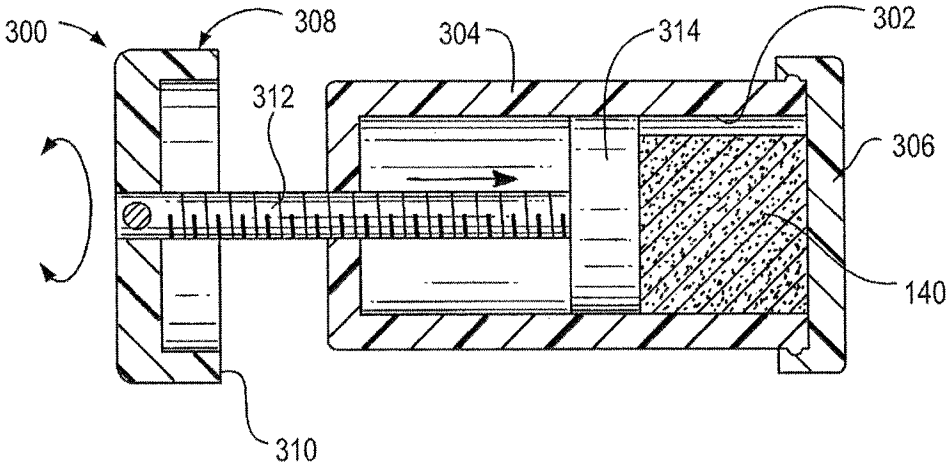
FIG. 19 is a sectional view of still another embodiment of a food handling device in accordance with this disclosure.

FIG. 19 depicts another embodiment of a food handling or dispensing device 300 in which a solid and/or non-solid foodstuff 140 is mounted in a chamber 302 of a tubular holder 304. A detachable end cap 306 is removably mounted at one end of the holder 304. A movable member 308 includes a handle 310 outside the holder 304, and a shaft 312 that threadedly engages an opposite end of the holder 304, and that extends into the chamber 302. A pusher 314 is mounted at the end of the shaft 312. Once the cap 306 is removed, manually turning the handle 310 causes the shaft 312 to turn and the pusher 314 to advance axially, thereby horizontally pushing the foodstuff 140 out of the chamber 302. Advantageously, a user turns the handle 310 in angular increments so that the solid foodstuff 140 can be directly fed to the user's mouth and sanitarily eaten bite-by-bite without the aid of eating accessories, such as plates and/or utensils, as well as without one's hands directly touching and contaminating the foodstuff 140 to prevent the spread of disease.

Figure 20:
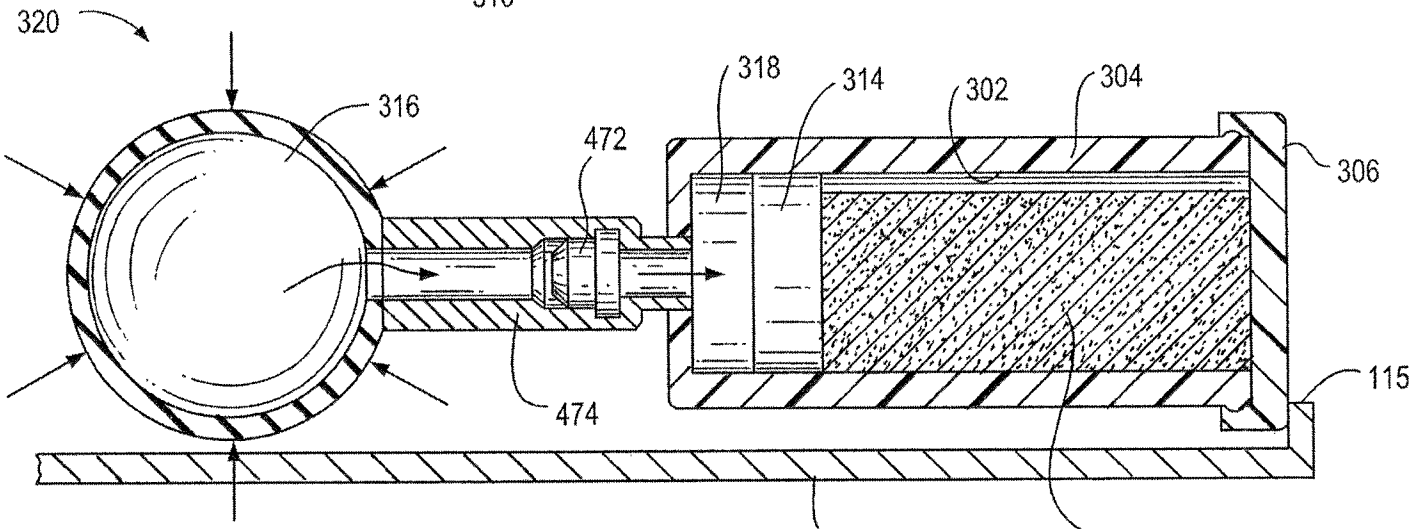
FIG. 20 is a part-sectional view of yet another embodiment of a food handling device in accordance with this disclosure.

FIG. 20 depicts another embodiment of a food handling device 320 that is similar to the food handling device 300, except that the handle 308 and the shaft 312 have been replaced by a squeezable air pump 316 that is in gaseous communication via a check valve 472 in a duct 474 with an internal pressure compartment 318 of the holder 304. Advantageously, once the cap 306 is removed, a user manually squeezes the pump 316 in increments so that pressurized air is admitted into the duct 474 and pushes against and moves the check valve 472 to an open position, thereby opening a flow path to the internal pressure compartment 318. The pressurized air in the internal pressure compartment 318 then urges the pusher 314 axially, and also horizontally and incrementally advances the foodstuff 140, thereby again allowing the foodstuff 140 to be directly fed to the user's mouth and sanitarily eaten bite-by-bite without the aid of eating accessories, such as plates and/or utensils, as well as without one's hands directly touching and contaminating the foodstuff 140 to prevent the spread of disease. FIG. 20 also depicts the aforementioned platter 114 on which any of the food handling devices described herein may be supported. Advantageously, the platter 114 has a peripheral, raised flange 115 to prevent any food handling device from accidentally falling off the platter 114 when the platter 114 is tilted and/or when the height of the support 112 is adjusted. The food handling device may be placed against the flange 115 to hold the food handling device in place while a user eats directly from the device while holding the support 112 in one hand, FIG. 21 depicts another embodiment of a food handling or dispensing device 330 that may be removably mounted inside an outer housing 332 that has a removable cap 334. Preferably, the housing 332 and the cap 334 are made of a thermally-insulating material to serve as a thermos for a foodstuff in the food handling device 330. The food handling device 330 includes a tubular holder 336 having an internal compartment 338 in which a foodstuff is contained during eating. An end closure 340 is threadedly connected at region 342 to the holder 336. A movable member includes a handle 344, an annular corrugated member 346, an annular indexing member 348, and a pusher 350 that is connected to the corrugated member 346, for example, by a pin connector 476. The outer surface of the corrugated member 346 has a series of annular peaks or ridges that alternate with a series of annular valleys or grooves. The indexing member 348 is fixedly held within the end closure 340 and, as shown in FIG. 22, has a series of radially extending, resilient fingers 352 separated by radial slits. Advantageously, once the cap 334 is removed, a user manually pushes the handle 344 and the corrugated member 346 axially until the fingers 352 of the indexing member 348, which initially is seated in one of the valleys, resiliently yield, and allow the indexing member 348 to become seated in another of the valleys of the corrugated member 346. The incremental, stepwise advancement of the corrugated member 346 also horizontally and incrementally advances the pusher 350 and the foodstuff lengthwise along the chamber 338 so that the foodstuff can be directly fed to the user's mouth and sanitarily eaten bite-by-bite without the aid of eating accessories, such as plates and/or utensils, as well as without one's hands directly touching and contaminating the foodstuff 140 to prevent the spread of disease. The user can also grip the handle 344 and manually retract the pusher 350 horizontally in order to reload the food handling device with another foodstuff.

Figure 23:
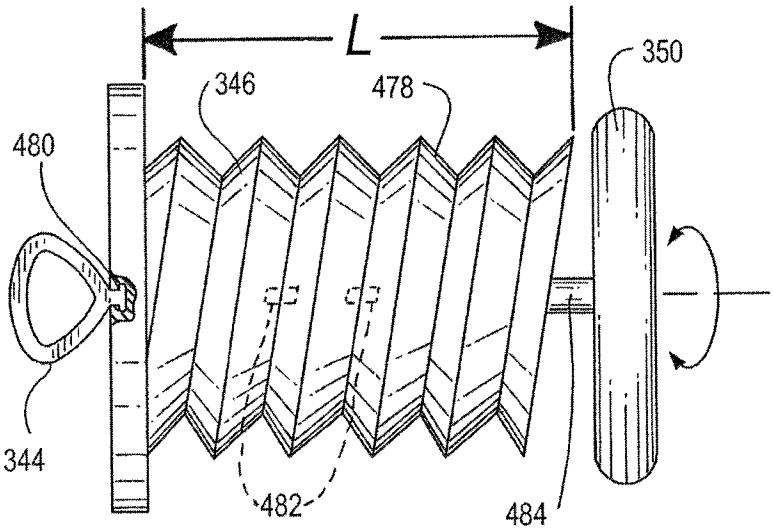
FIG. 23 is a side view of a variant detail of the embodiment of FIG. 21.

Alternatively, as shown in FIG. 23, the member 346 can be provided with an outer spiral thread 478 so that the handle 344 and the member 346 can be manually turned in one circumferential direction in a manner analogous to advancing a screw to advance the member 346 relative to the indexing member 348. Manually turning the handle 344 and the member 346 in an opposite circumferential direction causes the member 346 to retract in order to make room for another foodstuff As also shown in FIG. 23, the handle 344 may be pivotably connected to the member 346 at pivot 480 to allow the handle to be folded flat when not in use against the member 346. The member 346 can be of one-piece construction, or may comprise a plurality of sections, each attachable by a connector 482 to a shaft 484. The number of such sections is selectable to adjust the length "L" of the member 346. The size and shape of the ridges, grooves, and the spiral is also selectable to adjust the size of each increment by which the foodstuff is advanced. The member 346 is cleanable and re-usable.

Figure 24:
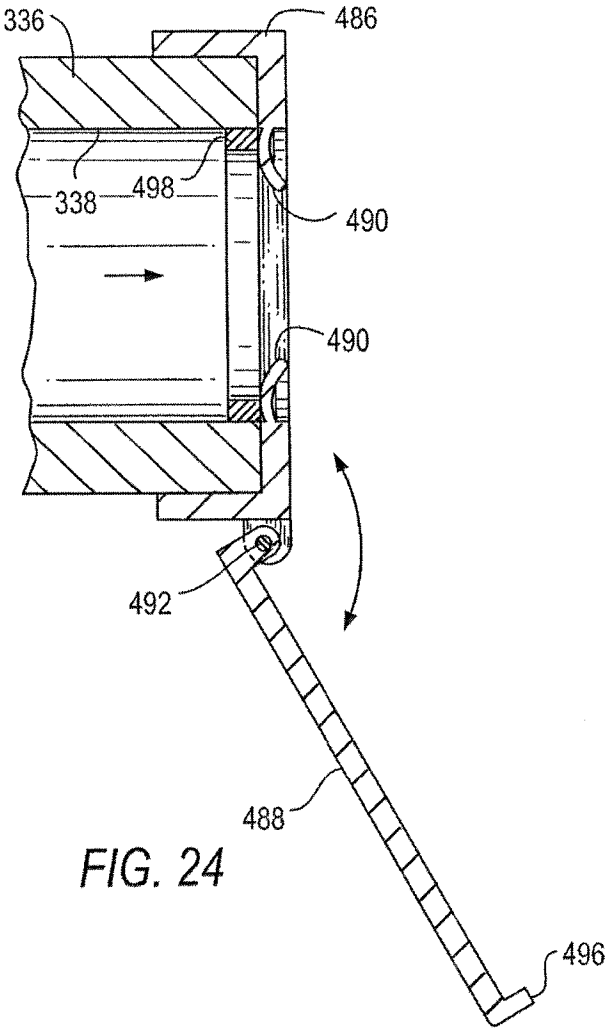
FIG. 24 is a broken-away, side sectional view of another detail of the embodiment of FIG. 21.

FIG. 24 depicts a front end piece 486 that is threadedly mounted at the outer end region of the tubular holder 336. A closure 488 is pivotably mounted on the front end piece 486 at the pivot 492 for movement between an open and a closed position. The closure 488 has a fastener 496 that engages the front end piece 486 in the closed position. As shown in FIG. 25, the front end piece 486 has a plurality of equiangularly arranged, concave, resilient lips 490 constituted of a soft, flexible material. The lips 490 bound a central dispensing opening 494. In the open position, when the user either axially manually pushes the member 346 (FIG. 21) or manually rotates the member 346 (FIG. 23), the foodstuff is pushed out through the opening 494 past the lips 490 directly into the user's mouth so that it can be sanitarily eaten bite-by-bite without the aid of eating accessories, such as plates and/or utensils. The lips 490 help prevent accidental spillage of the foodstuff. The soft and concavely curved nature of the lips 490 enables them to be comfortably positioned in contact with the user's lips and mouth. A sensor, e.g., a transducer 498, is threadedly mounted inside the tubular holder 336 adjacent to the front end piece 486. The sensor 498 is an annular disc having a central opening through which the foodstuff is pushed. The sensor 498 includes a strain gauge that can measure the quantity of the foodstuff that has been moved through the front end piece 486 and has been eaten. This information can be stored, together with the caloric value of the particular foodstuff, and can be sent to remote monitoring facilities that calculate the user's daily calorie consumption data, to thereby monitor the health, and assist in controlling the weight of, the user.

Figures 26, 27, 28:
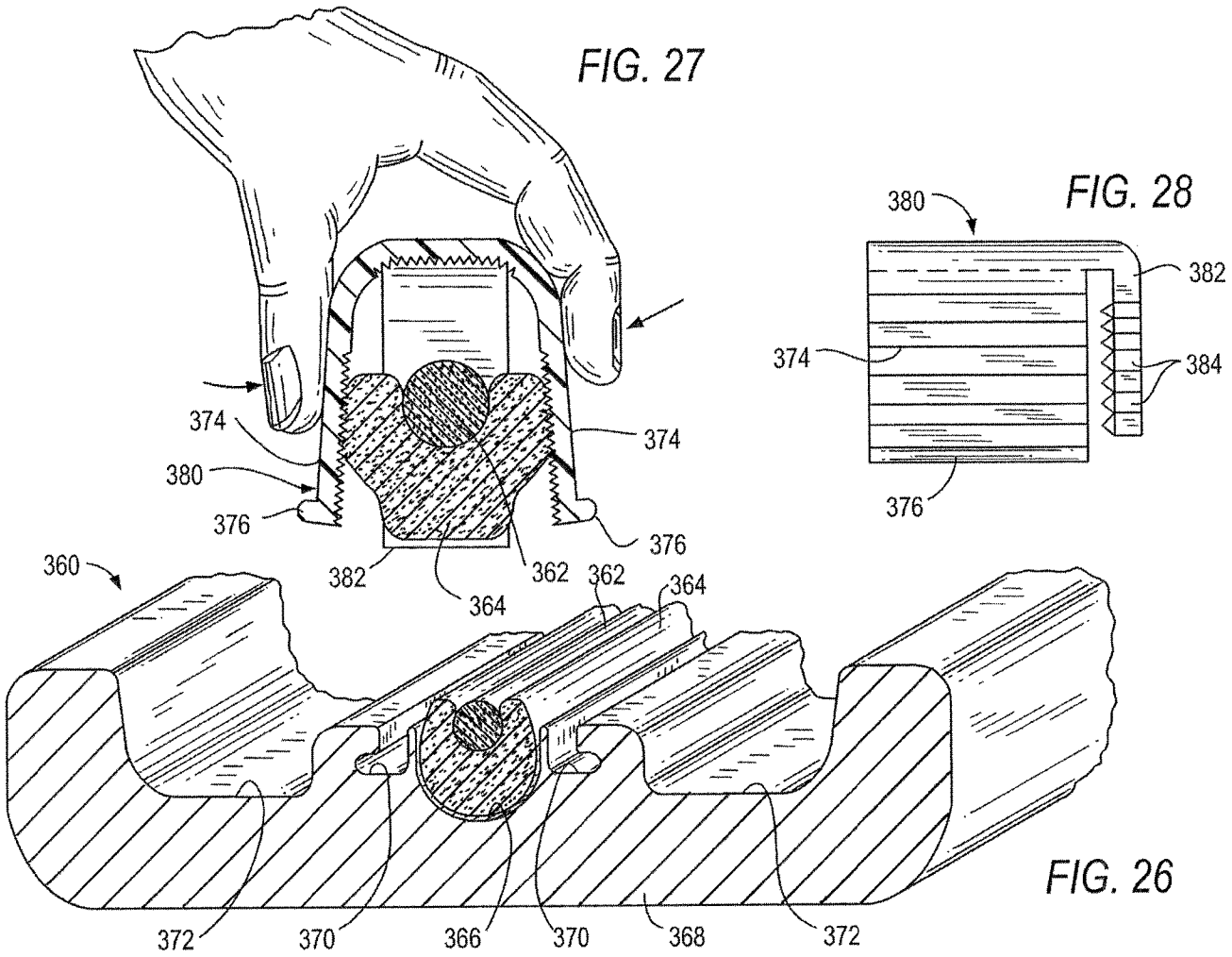
FIG. 26 is a broken-away, part-sectional, perspective view of another embodiment of a food handling device in accordance with this disclosure.
FIG. 27 is a sectional view of a food handling component used with the food handling device of FIG. 26.
FIG. 28 is a side view of the food handling component of FIG. 27.

FIG. 26 depicts another embodiment of a food handling or dispensing device 360 that is advantageously configured for eating a hot dog, i.e., a cooked sausage 362 served in a sliced bun 364, or a burrito, or like solid foodstuffs. The hot dog is placed in a longitudinal main channel 366 of a holder 368. The holder 368 has a pair of longitudinal guide channels 370 at opposite sides of the main channel 366, and may have another pair of side channels 372 at opposite sides of the guide channels 370. The side channels 372 may advantageously hold condiments, such as mustard, or other foodstuffs, such as relish or sauerkraut. FIGS. 27-28 depict a movable member 380 that is used to manually advance the hot dog being served on the food handling device 360. The movable member 380 has a pair of resilient side walls 374 that may be urged toward each other to capture the hot dog therebetween. The inner surfaces of the side walls 374 may be roughened or serrated to better grip the hot dog. The side walls 374 have lower feet 376 that are slidably mounted in the guide channels 370. Advantageously, a user manually squeezes the side walls 374 together to grip the hot dog, and then incrementally manually advances the hot dog lengthwise of the main channel 366 so that the hot dog can be directly fed into the user's mouth and sanitarily eaten bite-by-bite without the aid of eating accessories, such as plates and/or utensils, as well as without one's hands directly touching and contaminating the hot dog to prevent the spread of disease. As shown in FIG. 28, an end wall 382 is provided at the rear of the movable member 380. The hot dog can abut the end wall 382. A series of detachable portions 384 may be provided on the end wall 382. The inner surfaces of the detachable portions 384 may be roughened or serrated to better grip the hot dog. A selected number of the detachable portions 384 may be detached from the end wall 382 to adjust the height of the end wall 382 to better match the height of the hot dog. As shown in FIG. 28, the side walls 374 may also be corrugated and compressible to adjust the height and width of the side walls 374 to better match the height and width of the hot dog. The corrugated side walls 374 provide a better grip on, and also provide better heat isolation from, the hot dog.

Figure 31:
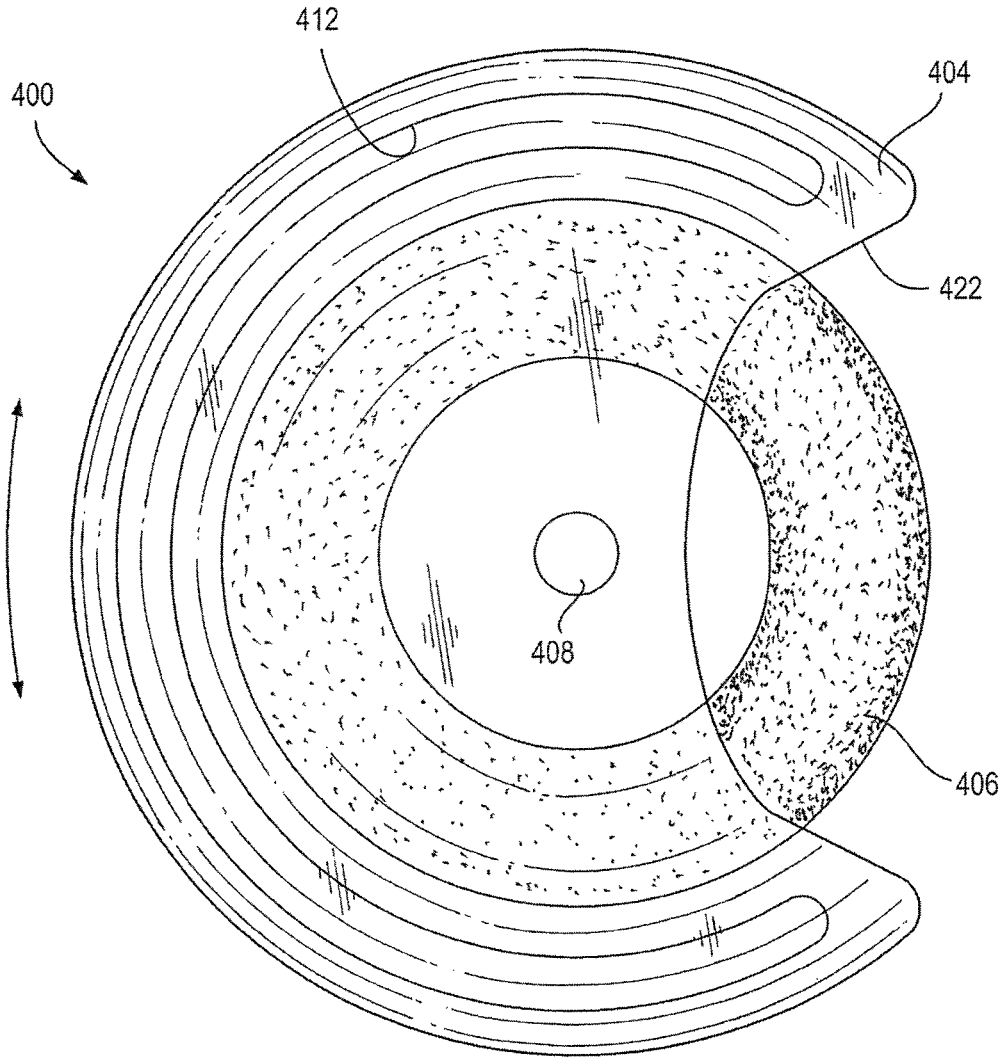
FIG. 31 is an enlarged, top plan view of the food handling device of FIG. 30.

FIGS 29-31 depict another embodiment of a food handling or dispensing device 400 that is advantageously configured for eating a doughnut, a bagel, a cake, or an analogous solid foodstuff 406. The food handling device 400 includes a holder 404 that has a central projection 408 that can extend into a central hole in the foodstuff 406, an annular main channel 410 that surrounds the projection 408 and that holds the foodstuff 406 and an annular side channel 410 that surrounds the main channel 410 and that may advantageously hold condiments or the like. A central bore 414 underneath the projection 408 receives a stub 416 of a housing 402 in which the food handling device 400 may be contained. The housing 402 may have snap-type connectors 418 or other connectors to enable the housing 402 to be opened or closed. A movable member 420 rests on top of the foodstuff 406 and is manually turnable in either circumferential direction about a vertical axis. An inner surface of the movable member 420 may be roughened or serrated to better grip the foodstuff 406. As shown in FIG. 31, the movable member 420 has a cutout 422 in which a portion of the foodstuff 406 is exposed. Advantageously, a user manually turns the movable member 420 to a desired angular extent, and can directly eat the portion of the foodstuff exposed in the cutout 422 in a sanitary, bite-by-bite manner without the aid of eating accessories, such as plates and/or utensils, as well as without one's hands directly touching and contaminating the foodstuff 140 to prevent the spread of disease. The cutout 422 is provided with rounded edges that are not sharp to prevent injury to the user during eating.

FIGS. 32-33 depict still another embodiment of a food handling or dispensing device 450 in which the foodstuff is mounted in a chamber 452 of a tubular holder 454. The closure 488 and the front end piece of FIG. 24 may be mounted on the outer end of the holder 454. A movable member includes a motor 456 outside the holder 454, and a shaft 458 that threadedly engages the holder 454, and that extends into the chamber 452. A food stop or abutment member 460 is mounted at the end of the shaft 458 to abut against a foodstuff received in the chamber 452. The motor 456 is operative for automatically turning the shaft 458 in either circumferential direction under the control of controllers 462. The motor 456 is mounted on a support 464 and is energized by a battery 461. A sliding piston 466 is mounted for telescoping sliding movement inside a cylinder 468 that is mounted on the support 464. The piston 466 is connected to the holder 454 by a pin 471. A heater 470 may be provided on the holder 454 to warm the foodstuff therein. Advantageously, a user actuates a controller 462 to energize the battery-powered motor 456 and turn the shaft 458 in one circumferential direction, thereby causing relative motion between the stop 460 and the holder 454. The foodstuff remains stationary, while the holder 454 is moved horizontally and incrementally toward the left in FIG. 32. The foodstuff is thus incrementally exposed so that it can be directly eaten in a sanitary, bite-by-bite manner without using eating accessories, such as plates and/or utensils, as well as without one's hands directly touching and contaminating the foodstuff to prevent the spread of disease. The user can actuate the other controller 462 to energize the motor 456 and turn the shaft 458 in the opposite circumferential direction, thereby causing the holder 454 to move toward the right in FIG. 32, whereupon the holder 454 may be loaded with another foodstuff. The aforementioned sensor 498 (FIG. 24) can also be supported by the holder 454 at its front end region to measure the quantity that the foodstuff has been moved.

Figure 34:
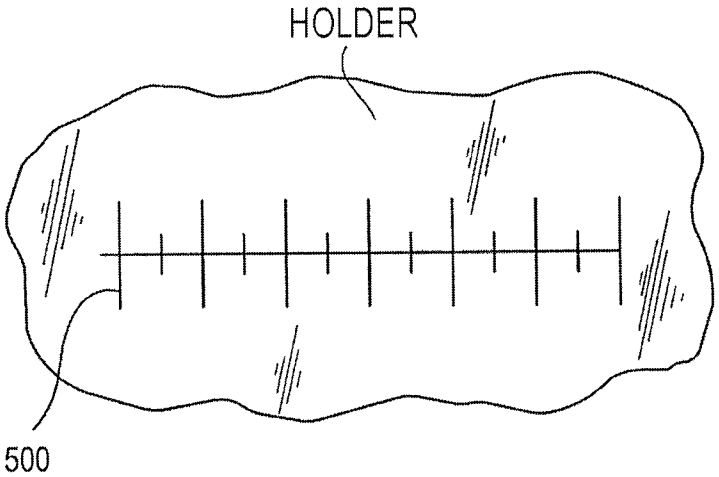
FIG. 34 is a broken-away, top view of a detail of the food handling devices.

The food handling devices disclosed herein can be advantageously used virtually anywhere indoors or outdoors, and even in weightless environments, in many different types of activities. The various holders disclosed herein, e.g., holders 304, 336 and 454, may advantageously be constituted of a light-transmissive material on which a series of markings 500, as shown in FIG. 34, is applied. The markings 500 may be accompanied by alphanumeric indicia and may be formed integrally with the holders, or may be printed or otherwise applied on the holders. The foodstuff is visible through the respective light-transmissive holder, and the markings 500 serve as visual indicators as to the distance through which the foodstuff has been moved or exposed. This distance can be used to determine the caloric value of the particular foodstuff being eaten. The food handling devices disclosed herein can be advantageously made at least in part of disposable and/or biodegradable materials. The food handling devices disclosed herein can be washed in a dishwasher, cooled in a refrigerator, and heated in a microwave oven.

Figure 35:
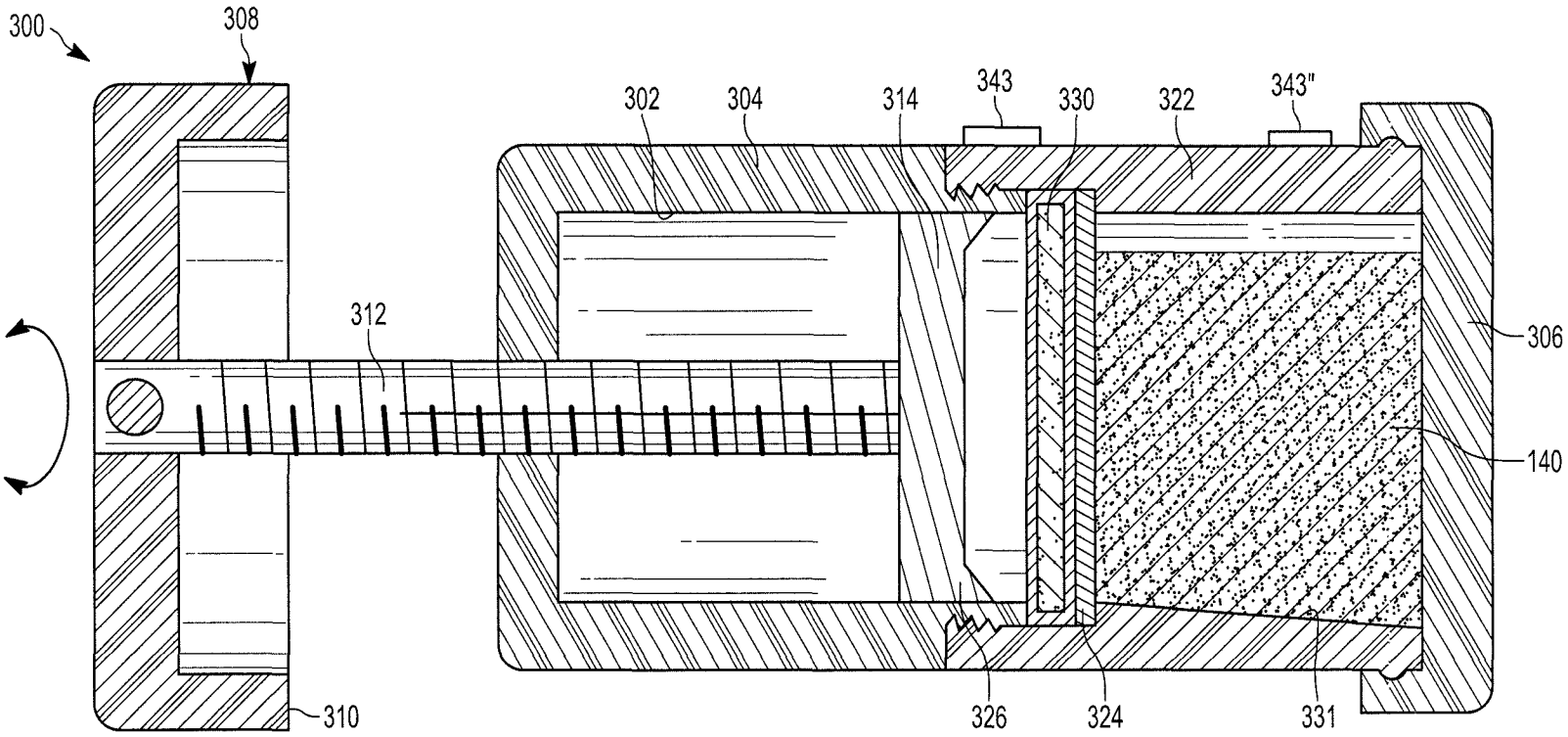
FIG. 35 is a sectional view analogous to FIG. 19, but of still another embodiment of a food handling device in accordance with this disclosure.

FIG. 35 depicts another embodiment of a food handling or dispensing device that is analogous to the device 300 of FIG. 19, and hence, like reference numerals have been used to identify like parts. Instead of the foodstuff 140 being placed in the holder 304, the foodstuff 140, either in solid, liquid, hard, soft, or viscous form, is mounted inside a tubular extension housing 322. The detachable end cap 306 is removably mounted at one open end of the extension housing 322. A thin membrane or film 324, preferably made of a pierceable, cuttable, rupturable material, such as metal foil, paper, or plastic, is mounted at the opposite open end of the extension housing 322 and hermetically seals the foodstuff 140 therein. The extension housing 322 is detachably mounted on the holder 304. For example, the extension housing 322 may be threadedly mounted as shown, or can be mounted with a snap type action, or with any other type of removable connection. The pusher 314 is modified from that shown in FIG. 19 to have a sharp annular projection or peripheral barb 326 on its leading face. Once the cap 306 is removed, manually turning the handle 310 causes the shaft 312 to turn, the pusher 314 to advance axially, the barb 326 to cut and pierce the film 324 about its perimeter, and the foodstuff 140 to be horizontally pushed out of the extension housing 322. Advantageously, a user turns the handle 310 in angular increments so that the solid foodstuff 140 can be directly fed to the user's mouth and sanitarily eaten bite-by-bite without the aid of eating accessories, such as plates and/or utensils, as well as without one's hands directly touching and contaminating the foodstuff 140 to prevent the spread of disease.

Figure 36:
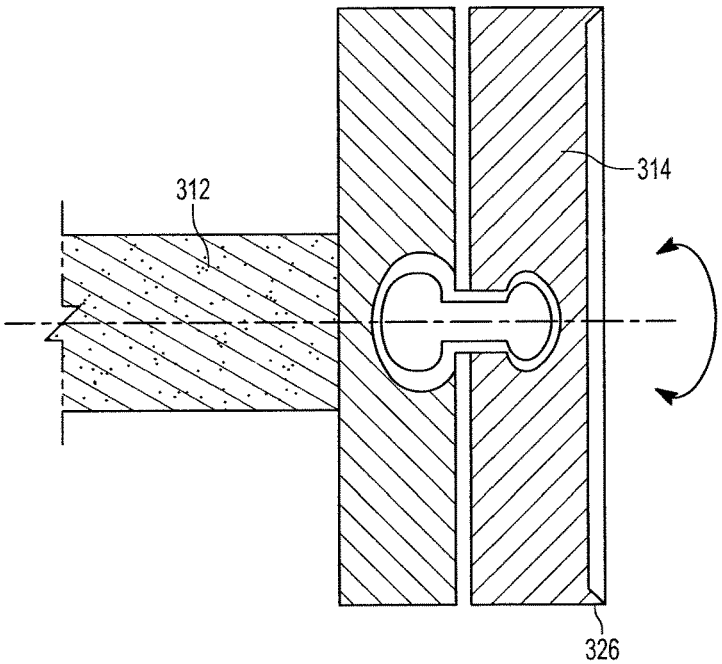
FIG. 36 is a broken-away, enlarged, sectional view of a variant construction of the food handling device of FIG. 35.
Figure 37:
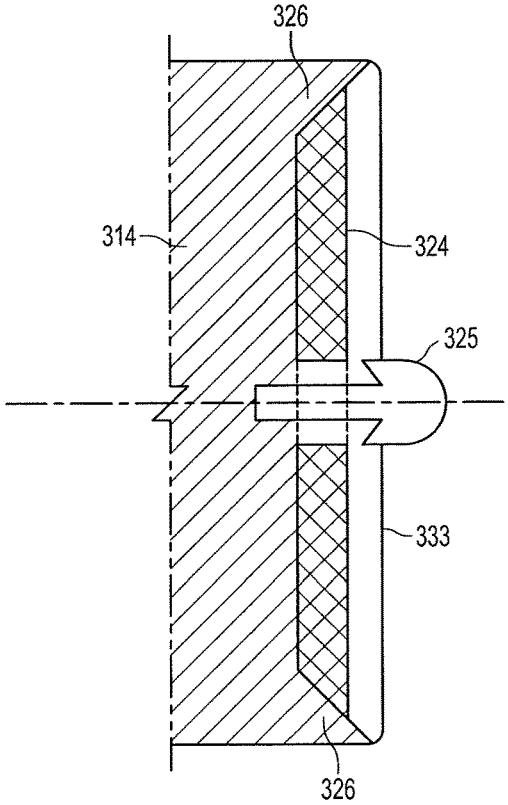
FIG. 37 is a broken-away, enlarged, sectional view of another variant construction of the food handling device of FIG. 35.

In a modification, as shown in FIG. 36, the pusher 314 is not connected directly to the shaft 312, but instead, is connected via a ball-and-socket connection to a shaft member 328. In this variant, the pusher 314 can also swivel during its axial advancement. In another modification, as shown in FIG. 37, a perforator 325 having a curved, mushroom-shaped, undercut head is fixedly mounted, for example, by a press fit, in a central region of the pusher 314 such that the head of the perforator 325 is axially spaced away from the pusher to form a pocket or compartment 333. When the pusher 314 is advanced axially as described above, the perforator 325 initially penetrates, cuts and pierces through a central area of the film 324, and then the barb 326 penetrates, cuts and pierces through the sealed outer peripheral area of the film 324. The cut film 324 is received in the compartment 333 and is hooked and retained therein by the undercut head of the perforator 325, thereby insuring that no part of the cut film 324 will be mixed in with, and contaminate, the foodstuff 140 during eating.

In still another modification, a cartridge 330 (see FIG. 35) may be inserted, and tightly held in place, between the pusher 314 and the foodstuff 140. The cartridge 330 is premanufactured of a pair of generally circular, pierceable, cuttable and rupturable walls and typically contains some desired food additive or flavoring, e.g., mustard, mayonnaise, ketchup, soy sauce, jam, honey, salt, pepper, salad dressing, and the like, between the pierceable walls. The cartridge 330 is air-tight and hermetically sealed. The cartridge 330, similar to the film 324, is penetrated, cut and pierced by the perforator 325 and by the barb 326, and the food additive contained in the cartridge 330 is mixed in with the foodstuff 140 during the advancement of the pusher. A user selects one or more of the cartridges 330 to add the desired flavoring(s) to the foodstuff. Although only one cartridge 330 and only one extension housing 322 are illustrated in FIG. 35, it will be understood that more than one cartridge and more than one extension housing 322 may be mounted on the holder 304. To aid in the intermixing of the food additive(s) with the foodstuff, at least one spiral channel or inclined groove 331 (see FIG. 35) may be provided in the extension housing 322 to help guide the mixture towards the user's mouth. A user may also rotate and/or shake the entire assembly to promote the intermixing of the food additive(s) with the foodstuff.

Figure 37A:
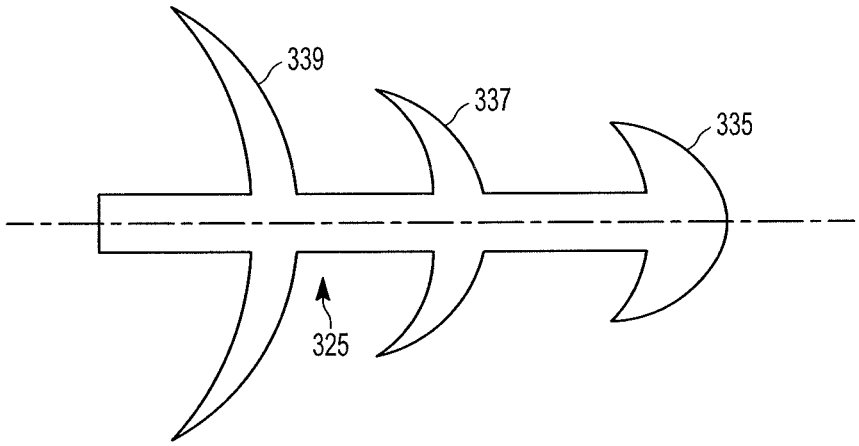
FIG. 37A is a sectional view of a modified detail of the food handling device of FIG. 37 in isolation.

In a modification of the perforator 325, the perforator 325 may have a plurality of curved, mushroom-shaped, undercut heads 335, 337, 339, as shown in FIG. 37A. The undercut heads 335, 337, 339 are axially spaced apart of one another and have diameters that successively increase in size. Thus, the leading undercut head 335 has the smallest diameter; the trailing undercut head 339 has the largest diameter; and the intermediate undercut head 337 has a diameter whose size is greater than that of the leading undercut head 335 and smaller than that of the trailing undercut head 339. The multi-headed perforator 325 of FIG. 37A gradually and easily penetrates, cuts and pierces the cartridge(s) 330 and the film 324 of the extension housing 322. After penetration, each undercut head may simultaneously hold one or more of the cartridge(s) 330 and one or more film(s) 324 in the respective pockets 333 behind the heads.

In still another modification, the extension housing 322 may he provided with one or more stickers or labels 343, 343' (see FIG. 35) that bear information. The stickers 343, 343' can be provided at opposite end regions of the extension housing 322 and may have machine- or human-readable codes, such as barcodes or QR codes, printed thereon. For example, a first sticker 343 located at the end region closer to the film 324 may contain the ingredients, the calories, and the expiration date of the contents of the extension housing, and the second sticker 343' located at the opposite end region further from the film 324 may contain similar or different information. Before eating, a user may scan the first sticker 343 with a mobile device, such as a smartphone, and record the date and time of first use and may scan the second sticker 343' with the same mobile device after consumption and record the date and time that the contents were consumed. A complete record is thus kept of what was eaten, and when it was eaten. This recorded information can be stored, together with the caloric value of the particular foodstuff, either on the user's smartphone or can he sent to remote monitoring facilities that calculate the user's daily calorie consumption data, to thereby monitor the health of the user. When the extension housing 322 contains medicine to he consumed, then the recorded information is of particular interest to the patient and/or health professionals.

The extension housing 322 of FIG. 35 is a detachable, re-usable or disposable, hermetically sealed, air-tight container for the foodstuff 140 and can, for example, be refrigerated, heated, boiled, microwaved, or otherwise cooked to prepare the foodstuff for eating. Different containers containing different foodstuffs can he readily mounted on the holder 304, and thus, would be advantageous not only for use in fast food or take-out restaurants, but also for everyday use by lunchtime diners. In addition, such containers could he beneficially used in disaster relief situations. If the foodstuff in the extension housing 322 is not eaten in its entirety, then the extension housing 322 may be detached from the holder 304, and an end cap, similar to the end cap 306, may be detachably mounted at the opposite open end of the extension housing 322, i.e., at the end where the film 324 was ruptured. The detached extension housing 322 and its uneaten contents may now be stored for future use.

Figure 38:
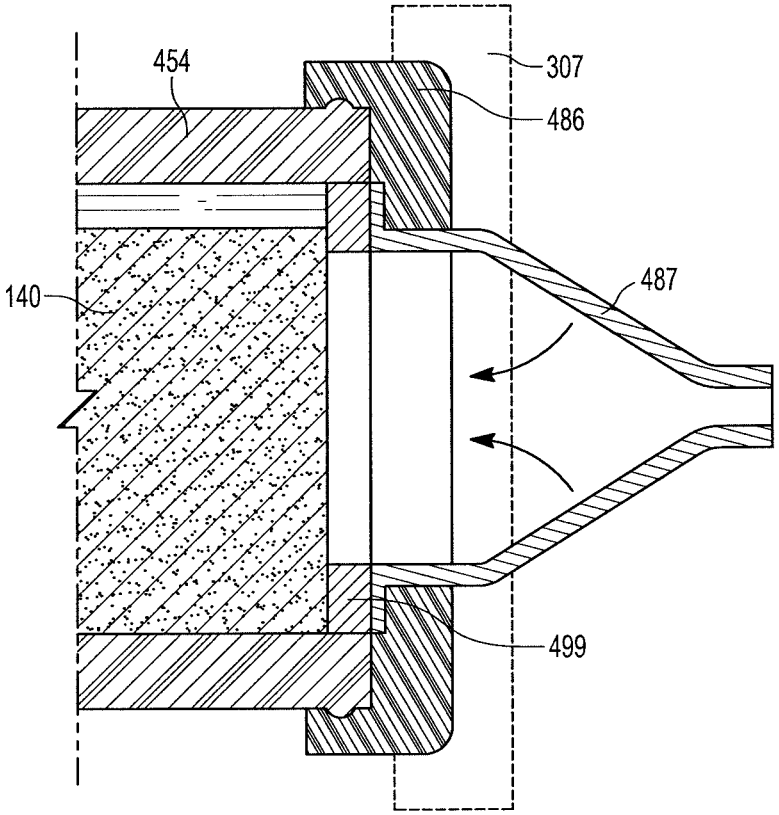
FIG. 38 is a broken-away end view of the assembly of FIG. 32, but of still another variation in accordance with this disclosure.

Although the extension housing 322 of FIG. 35 has been illustrated in connection with the embodiment of FIG. 19, it can also be used with other embodiments having tubular holders, such as shown, for example, in FIGS. 20, 21, and 32. The holder 304 and the extension housing 322 can be placed within a container that rigidly holds the holder 304 and the extension housing 322 together prior to use. Advantageously, the container may be carried or worn by a user with the aid of carrying straps, FIG. 38 depicts a modification of the motor-driven assembly of FIG. 32, together with a pressure sensor 499 that is in wired or wireless connection with the motor 456. The sensor or transducer 499 is mounted inside the tubular holder 454 adjacent to, and held by, a front end piece 486. The sensor 499 is an annular disc having a central opening through which the foodstuff passes. A mouthpiece 487, preferably made of a soft, flexible silicon material, is mounted on, and held in place by, the front end piece 486. After the mouthpiece is placed in a user's mouth, the user applies pressure that is detected by the sensor 499, thereby activating the motor 46 to supply a desired amount of food to the user. When the user stops eating, the lack of pressure is detected, and the sensor 499 deactivates the motor, thereby preventing the food from being supplied. The automatic remote activation and deactivation of the motor replaces the manual controllers 462 and is especially beneficial in the feeding of adults in rehabilitation, children, pets, etc. The sensor 499 may also be connected to a video camera to record and store the remote feeding process. When the device is not in use and when the mouthpiece 487 is not placed in the user's mouth, the mouthpiece 487 may be inverted in the direction of the arrows in FIG. 38, and covered by a removable end cap 307.

Figure 39:
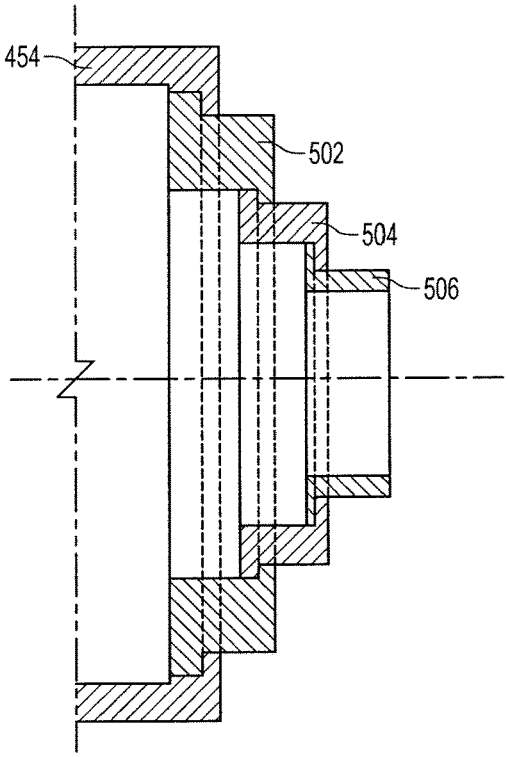
FIG. 39 is a broken-away end view of the assembly of FIG. 32, but of still another variation in accordance with this disclosure.

Instead of a flexible mouthpiece 487, the mouthpiece may be comprised of a plurality of collapsible telescoping sections 502, 504, 506, as shown in FIG. 39. Prior to eating, the sections are collapsed inside the tubular holder 454. During eating, the pressure of the advancing food is exerted against the sections until they reach their illustrated extended positions.

Figure 40:
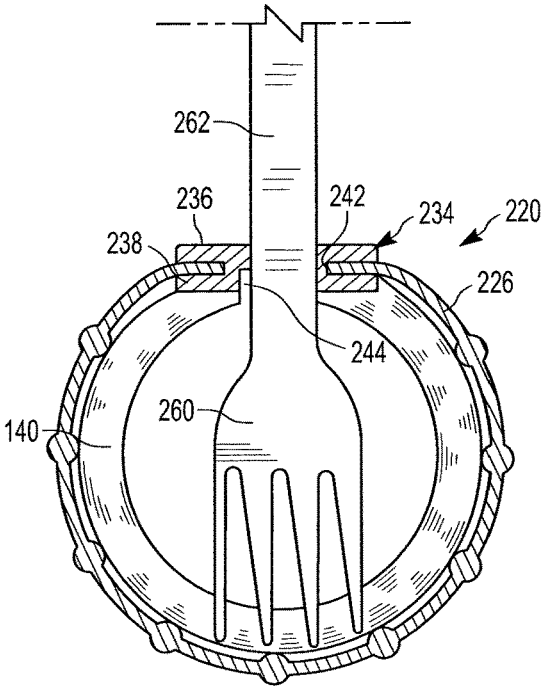
FIG. 40 is a sectional end view of a modified detail of the food handling device of FIG. 6.
Figure 41:
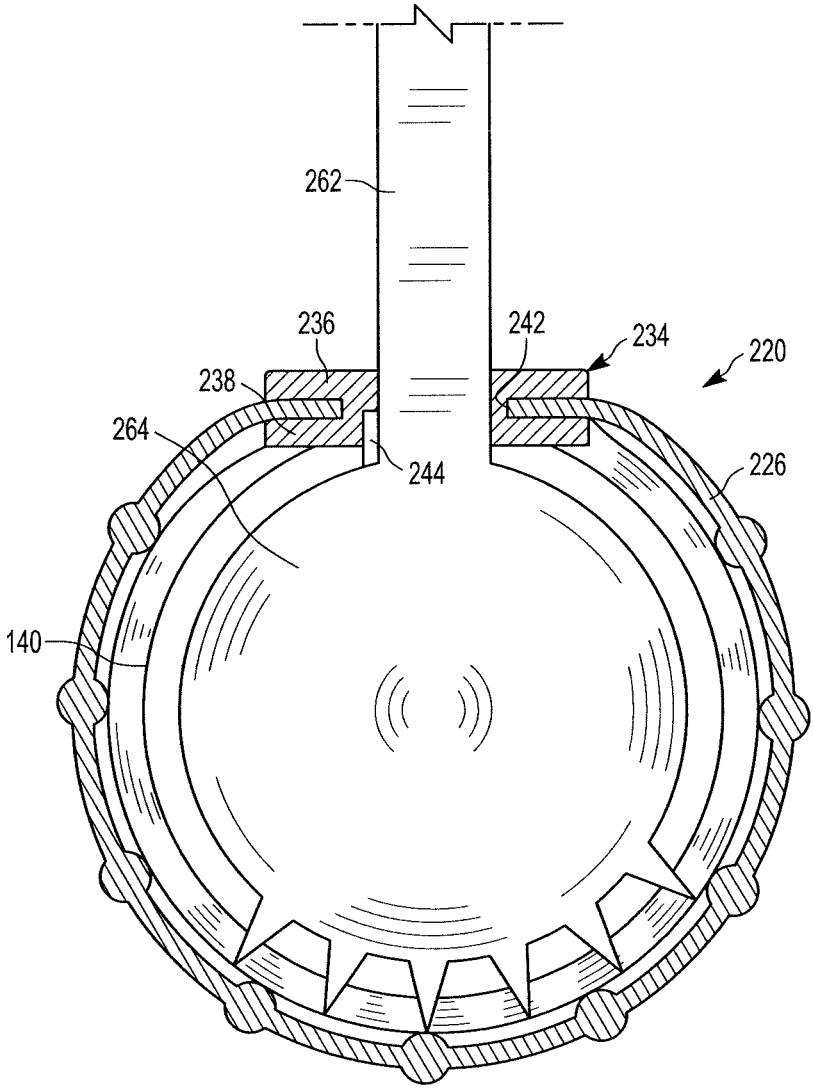
FIG. 41 is a sectional end view of another modified detail of the food handling device of FIG. 6.

FIGS. 40-41 depict variations of the L-shaped movable members 130, 240 shown in the embodiment of FIGS. 1-9, and instead, depicts an elongated eating utensil, such as a fork 260 (FIG. 40) and a spoon or spork 264 (FIG. 41). Using the same reference numerals as was used in connection with FIG. 6, the fork 260 or the spork 264 is inserted through the passage 244 until it reaches at or near the bottom of the tubular holder 226. The fork 260 or the spork 264 may be positioned behind the foodstuff to push the foodstuff from behind, or the fork 260 and the spork 264 may be inserted into the foodstuff to affirmatively grip the foodstuff during its advancement. To facilitate its insertion, the utensil 260, 264 is made of a highly flexible material. The handle 262 of the utensil 260, 264 extends through the longitudinal slot 228 and is moved lengthwise of the slot to advance a solid foodstuff The utensil 260, 264 can at any time be used for eating the foodstuff, or any other food. The utensil 260, 264 itself can even be made of an edible material. Similarly, the spoon or spork 264 can be inserted through the passage 244 until it reaches at or near the bottom of the tubular holder 226. The bowl shape of the spoon or spork 264 covers most of the interior area of the food chamber and can more efficiently move more of the foodstuff, such as a salad or a soft food, to the user's mouth.

Figure 42:
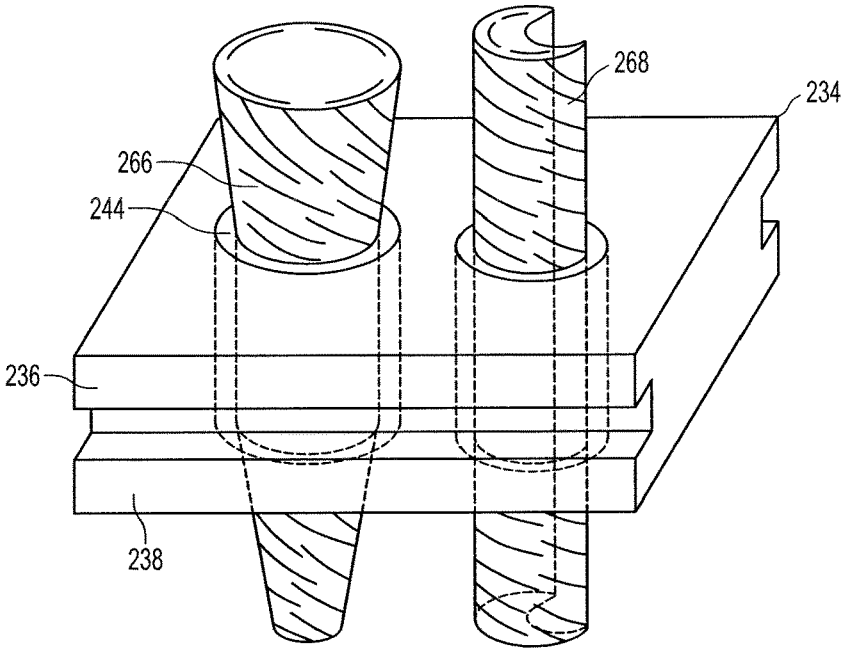
FIG. 42 is a perspective view of another modified detail of the food handling device of FIG. 6.

Instead of using eating utensils 260, 264, the movable members in the embodiment of FIGS. 1-9 can be constituted by certain foods, such as the carrot 266 or celery stalk 268, shown in FIG. 42. These foods can be inserted into and through respective passages 244 in the bracket 234 until it reaches at or near the bottom of the tubular holder 226. These foods are sufficiently rigid to push the foodstuff along the holder 226, and can also be eaten separately. Carrots, for example, are regarded as a superfood and a healthy snack. In a variation, the carrot 266 or celery stalk 268 are inserted directly into the tubular holder 226, in which case, the bracket 234 is not needed or used. In another variation, the holder 226 itself may be constituted of an edible material so that the holder 226 may be eaten. When the holder 226 contains pizza as the foodstuff, then the edibility of the utensils and/or of he holder 226 makes the entire combination a healthy pizza.

Figure 43:
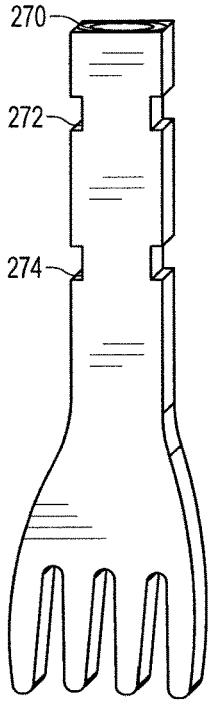
FIG. 43 is a perspective view of another modified detail of the food handling device of FIG. 4.

Rather than using the bracket 234, as described above in FIGS. 5-6 and 40-42, it is also contemplated that an eating utensil can be used without such a bracket. Thus, as shown for the fork 270 in FIG. 43, a first pair of side cutouts 272 is formed in the fork handle at one elevation, and a second pair of side cutouts 274 is formed in the fork handle at a different elevation. The fork 270 can be inserted into the holder 126 of FIG. 2 until a desired pair of the cutouts 272, 274 is received in the main slot 128. Thus, the elevation of the fork 270 is adjustable to contact the foodstuff at a desired height, and to move the foodstuff at that adjusted elevation.

Figure 44:
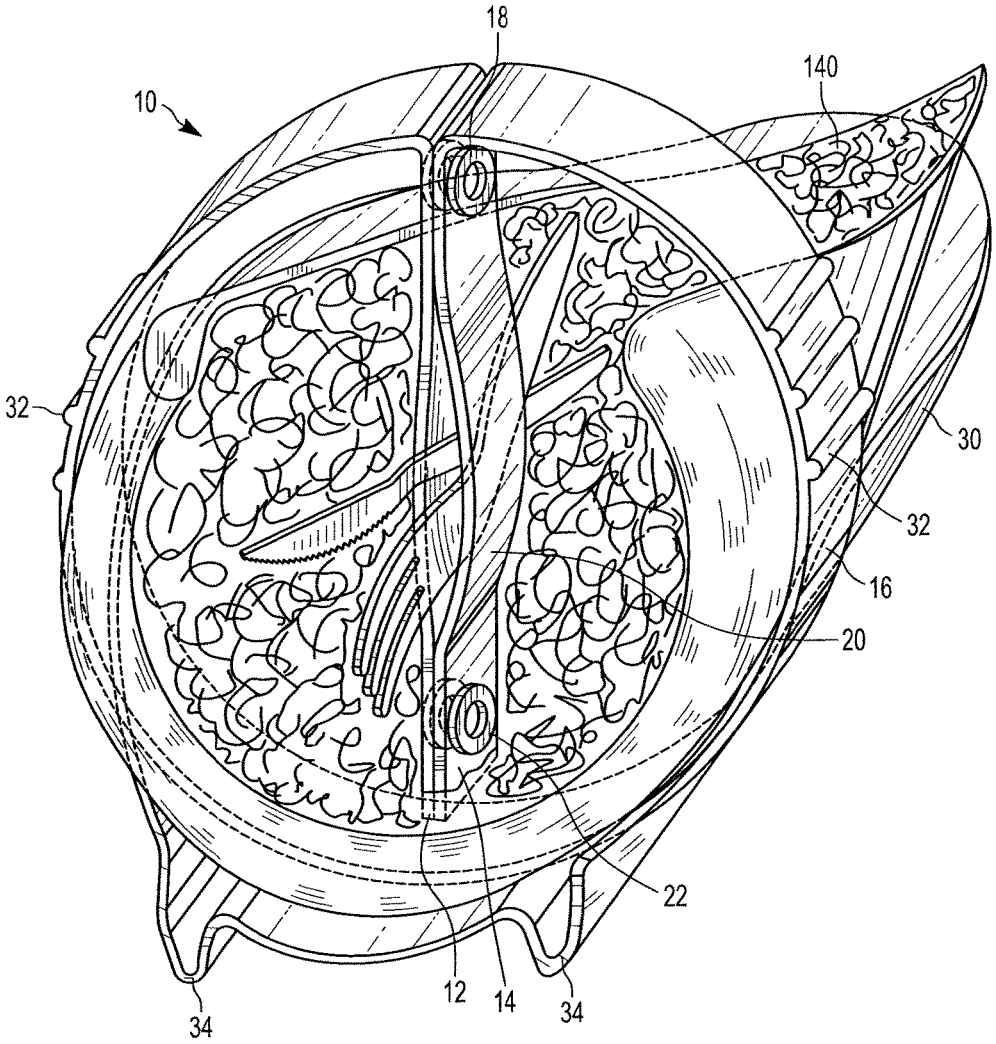
FIG. 44 is a perspective view of a modified version of the food handling device of FIG. 10.

FIG. 44 depicts a variation of the device 10 of FIG. 10. Ribs 32 or any analogous friction-enhancing structure, are provided at the exterior sides of the device to enhance a user's grip. The ribs 32 also serve as thermal insulators to prevent any heat from the pizza slice 140 or other hot foodstuff from being transferred to the user's hand. Feet 34, or any other support structure, are provided at the bottom of the device to allow a user to rest the device on any support structure, such as a table.

Figure 45:
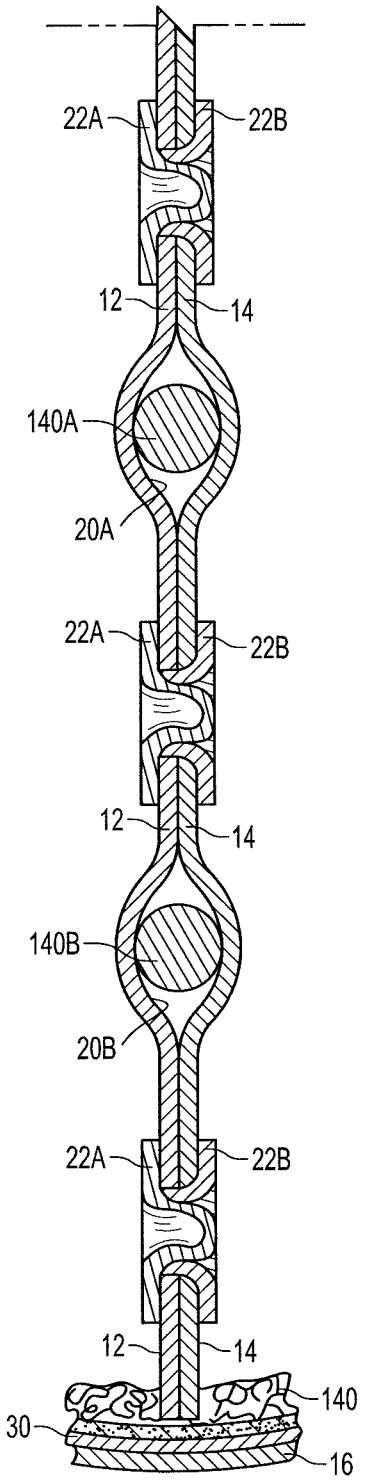
FIG. 45 is a sectional view of a modified detail of the food handling device of FIG. 44.

FIG. 45 depicts a variation of the interior of the device 10 of FIG. 10. Rather than forming a single annular central portion 20 for holding utensils, the variation of FIG. 45 depicts that a plurality of central portions 20A, 20B may be formed for holding additional foodstuffs 140A, 140B, such as hot dogs, corn dogs, corn, carrots, celery, etc. A plurality of detachable fasteners 2.2A, 22B, preferably of snap type action, is fastened together, with enough excess material from the annular body portion 16 of the strip, to form the annular central portions 20A, 20B. In other variations, the central portions 20A, 20B need not be integral with the annular body portion 16, but can be separate parts that are fastened to the strip. The central portions may, in another variation, extend upwardly above the annular body portion 16 to hold additional foods and/or utensils.

Figure 46:
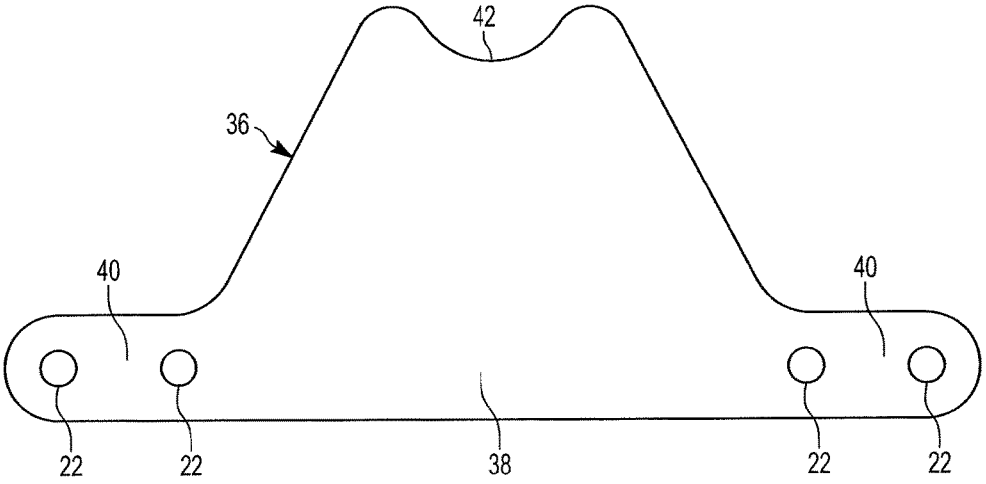
FIG. 46 is a plan view of a modified version of a detail of the food handling device of FIG. 10.
Figure 47:
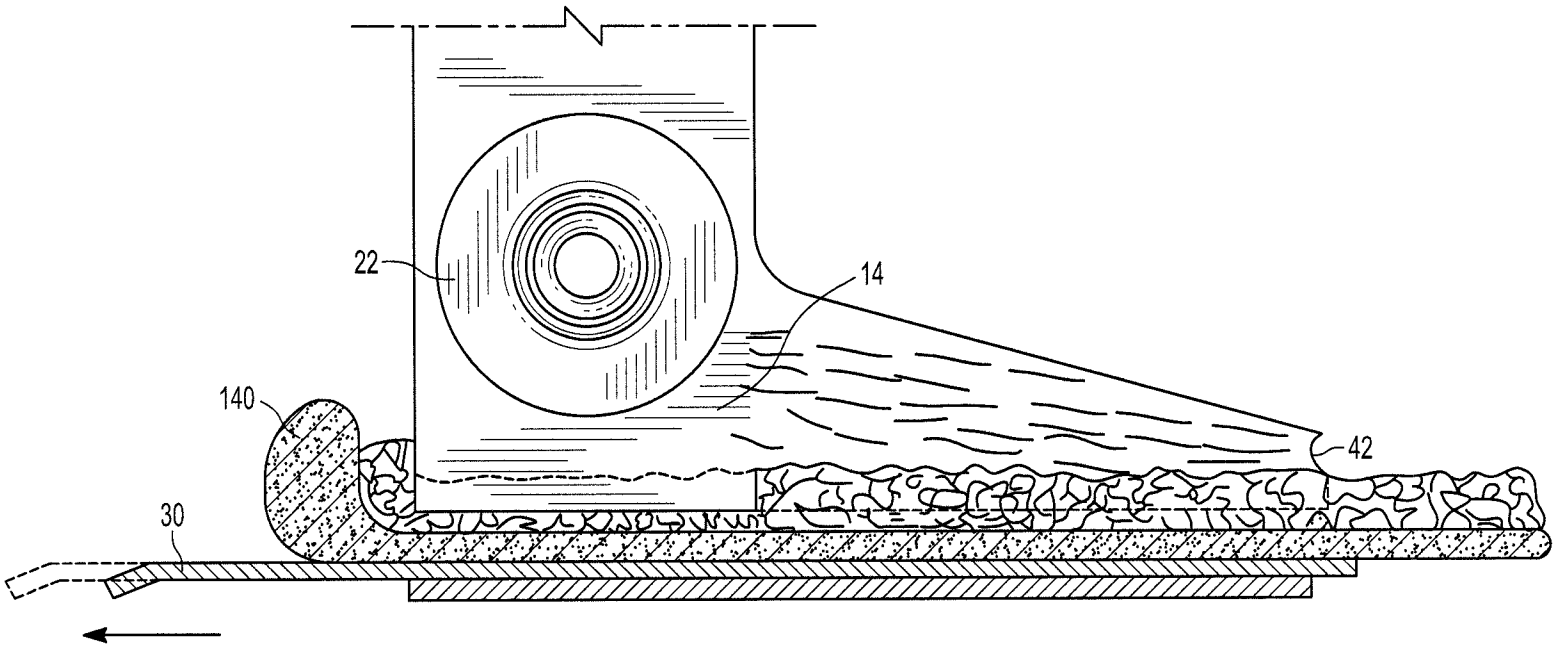
FIG. 47 is a sectional view of a modified version of the food handling device of FIG. 46.

FIG. 46 depicts a variation of the annular body portion 16 of the strip of FIG. 10. Rather than having a constant width, the annular body portion 36 of FIG. 46 has a variable width in plan view. The annular body portion 36 has an enlarged central section 38 and a pair of narrower collinear arms 40 on which the fasteners 20 are mounted in spaced-apart relationship. The central section has a concave edge 42. When folded into an annular shape, as shown in FIG. 47, the enlarged central section 38 provides additional support for the plate 30 and/or the pizza by itself. The concave edge 42 helps to insure that the user will not bite down hard on the central section 38 during eating.

Figure 45A:
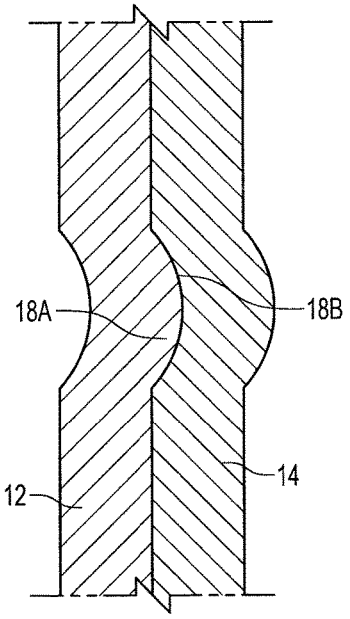
FIG. 45A is an enlarged sectional view of a modified detail of the food handling devices of FIGS. 10, 44 and 46.

FIG. 45A depicts a variation on the fasteners 18, 22, 22A and 22B of FIGS. 10-11, FIGS. 44-45 and FIGS. 46-47. Rather than using the illustrated separate, discrete fasteners 18, 22, 22A and 22B, the opposite end regions 12, 14 of the annular body portion 16 of the strip are integrally formed with one or more projections 18A and one or more recesses 18B. Each projection 18A is received in a respective recess 18B, preferably with a snap type action, at one or more locations along the opposite end regions 12, 14, thereby fastening the opposite end regions 12, 14 together at each of those locations. Thus, the use of discrete fasteners, such as fasteners 18, 22 22A and 22B, has been eliminated.

In the foregoing specification, specific embodiments have been described. However, one of ordinary skill in the art appreciates that various modifications and changes can be made without departing from the scope of the invention as set forth in the claims below. For example, although the various devices have been described as handling and dispensing foodstuffs, particularly solid foodstuffs, other foodstuffs, such as non-solid, liquid or viscous foods could also be dispensed. Furthermore, the items being dispensed need not be foodstuffs, but can be virtually any item required to be dispensed to a user. Accordingly, the specification and figures are to be regarded in an illustrative rather than a restrictive sense, and all such modifications are intended to be included within the scope of present teachings. For example, the food service assemblies and food handling devices described herein can also be used by campers, or military personnel, or participants in any outdoor or indoor activities, such as picnics, block parties, beach activities, hiking, or sports activities, especially those where it is difficult to keep one's hands clean. In accordance with this invention, one's hands do not directly touch and contaminate the foodstuff, thereby preventing the spread of disease and, in many embodiments, eating accessories, such as plates and/or utensils, are not required.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing," or any other variation thereof, are intended to cover a non-exclusive inclusion, such that a process, method, article, or apparatus that comprises, has, includes, or contains a list of elements does not include only those elements, but may include other elements not expressly listed or inherent to such process, method, article, or apparatus. An element proceeded by "comprises . . . a," "has . . . a," or "contains . . . a," does not, without more constraints, preclude the existence of additional identical elements in the process, method, article, or apparatus that comprises, has, includes, or contains the element. The terms "a" and are defined as one or more unless explicitly stated otherwise herein. The terms "substantially," "essentially," "approximately," "about," or any other version thereof, are defined as being close to, as understood by one of ordinary skill in the art. The term "coupled" is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

I claim:

1. A dispenser, comprising:

a holder having an interior chamber extending along a longitudinal axis;

an extension housing detachably mounted, connected, and held, on the holder, the extension housing having walls bounding an interior compartment for receiving and for holding an item to be dispensed inside the walls of the interior compartment, the walls of the interior compartment extending along the longitudinal axis to an opening;

a pusher mounted in the interior chamber for axial movement; and an actuator for axially moving the pusher through the interior chamber and through the interior compartment into contact with the item, and for feeding a continuously variable quantity of the item along the longitudinal axis through the opening.

2. The dispenser of claim 1, wherein the extension housing has opposite end regions, and a detachable closure for overlying and closing one of the end regions, and a film for overlying and closing the other of the end regions to seal the interior compartment of the extension housing from entry of outside contaminants.

3. The dispenser of claim 2, wherein the pusher has a leading annular projection having a barb for contacting, cutting into, and piercing through the film during the axial movement to form a pierced film.

4. The dispenser of claim 3, wherein the pusher includes a perforator for contacting, and passing through the film during the axial movement, the perforator having a curved, undercut head that bounds a pocket with the pusher, and wherein the curved, undercut head receives, hooks onto, and retains the pierced film in the pocket.

5. The dispenser of claim 1, wherein the pusher is connected with a swivel connection to the actuator and is mounted for swiveling movement relative to the actuator during the axial movement.

6. The dispenser of claim 1, and at least one cartridge replaceably mounted, and tightly held, between the pusher and the extension housing, wherein the at least one cartridge is disposable and constituted of a pair of pierceable walls between which another item is contained, and wherein the pusher has a leading projection having a barb for contacting, cutting into, and piercing through the pierceable walls of the at least one cartridge during the axial movement.

7. The dispenser of claim 6, wherein the extension housing has an end region that is overlain and sealed by a film constituted of a pierceable material, wherein both the film and the pierceable walls of the at least one cartridge are contacted, cut and pierced through by the barb of the leading projection to form a pierced film and at least one pierced cartridge, respectively, during the axial movement of the pusher to bring both the items together to form a mixture.

8. The dispenser of claim 7, wherein the pusher includes a perforator having a plurality of curved, undercut heads of successively greater size as considered along the longitudinal axis in a direction of advancement, and wherein at least one of the curved, undercut heads bounds a pocket with the pusher and receives, hooks onto, and retains the pierced film and the at least one pierced cartridge in the pocket during the axial movement.

9. The dispenser of claim 7, and at least one groove having at least one of an inclined surface and a spiral surface for guiding the mixture of both the items along the inclined surface to the opening.

10. The dispenser of claim 1, and a mouthpiece and a pressure sensor mounted at the opening, and wherein the actuator is activated when the sensor detects a pressure exerted by a user's mouth at the mouthpiece.

11. The dispenser of claim 1, and a mouthpiece mounted at the opening, and wherein the mouthpiece has a plurality of collapsible telescoping sections.

12. The dispenser of claim 1, and at least one label on the extension housing and bearing indicia that contains information relating to the item being dispensed.

13. The dispenser of claim 1, wherein the interior compartment has opposite end regions that are covered and closed to hermetically seals and holds a foodstuff as the item to be dispensed.

14. A food handling device for use in eating a foodstuff, comprising:

a holder having an interior chamber extending along a longitudinal axis;

an extension housing detachably mounted on, and connected to, the holder, the extension housing having walls bounding an interior compartment for receiving and for holding the foodstuff inside the walls of the interior compartment, the walls of the interior compartment extending along the longitudinal axis to an opening;

a pusher mounted in the interior chamber for axial movement; and an actuator for axially moving the pusher through the interior chamber and through the interior compartment into contact with the foodstuff, and for incrementally feeding a continuously variable quantity of the foodstuff along the longitudinal axis through the opening directly into a user's mouth to enable the foodstuff to he eaten bite-by-bite in a sanitary manner without using eating accessories.

15. The device of claim 14, wherein the extension housing has opposite end regions, and a detachable closure for overlying and closing one of the end regions, and a film for overlying and closing the other of the end regions to seal the interior compartment of the extension housing from entry of contaminations outside the extension housing.

16. The device of claim 15, wherein the pusher has a leading annular projection having a barb for contacting, cutting into, and piercing through a peripheral region of the film during the axial movement to form a pierced film.

17. The device of claim 16, wherein the pusher includes a perforator for contacting and passing through a central region of the film during the axial movement, the perforator having at least one curved, undercut head that hounds a pocket with the pusher, and wherein the at least one curved, undercut head receives, hooks onto, and retains the pierced film in the pocket.

18. The device of claim 14, and at least one disposable cartridge replaceably mounted, and tightly held, between the pusher and the extension housing, wherein the at least one disposable cartridge is constituted of a pair of pierceable walls between which a food additive is contained, and wherein the pusher has a leading projection having a barb for contacting, cutting into, and piercing through the pierceable walls of the at least one cartridge during the axial movement.

19. The device of claim 18, wherein the extension housing has an end region that is overlain and sealed by a film constituted of a pierceable material, wherein both the film and the pierceable walls of the at least one cartridge are contacted, cut, and pierced through by the barb of the leading projection to form a pierced film and at least one pierced cartridge, respectively, during the axial movement of the pusher to bring both the foodstuff and the additive together.

20. The device of claim 14, and a mouthpiece and a pressure sensor mounted at the opening, and wherein the actuator is activated when the sensor detects a pressure exerted by the user's mouth at the mouthpiece.

21. The dispenser of claim 1, and a mouthpiece and a pressure sensor mounted at the opening for detecting pressure exerted by the user's mouth at the mouthpiece, and wherein the pressure sensor is in wireless communication with the actuator for remote activation of the actuator when pressure is detected by the pressure sensor.

22. The dispenser of claim 1, and a mouthpiece and a pressure sensor mounted at the opening for detecting pressure exerted by the user's mouth at the mouthpiece, and wherein the pressure sensor is in wireless communication with the actuator for remote activation of the actuator when pressure is detected by the pressure sensor, and a camera connected to the pressure sensor for recording the feeding of the item for viewing.

23. An extension housing for holding a food item to be dispensed, comprising:

a re-usable or disposable, portable container having wails bounding an interior compartment for receiving and storing the food item to be dispensed inside the walls of the interior compartment, the wails of the interior compartment extending from one end region to an opposite end region of the container along a longitudinal axis;

a closure for overlying and closing an opening formed at the opposite end region of the container in a closed position, the closure being detachable and removable from the opposite end region of the container to form an opened closure in a dispensing position;

a film for overlying and closing the one end region of the container in a closed position, the film being made of a pierceable material that is pierced through to form a pierced film in a dispensing position;

wherein the film and the closure in each closed position being operative to seal the interior compartment of the extension housing from entry of contaminants to enable the food item to be treated prior to dispensing; and wherein the pierced film and the opened closure in each dispensing position being operative to enable the food item to be dispensed from the interior compartment of the extension housing.

* * * * *